US010770813B2

(12) United States Patent
Stone et al.

(10) Patent No.: US 10,770,813 B2
(45) Date of Patent: Sep. 8, 2020

(54) ENVIRONMENTALLY SEALED, REUSABLE CONNECTOR FOR PRINTED FLEXIBLE ELECTRONICS

(71) Applicant: Brewer Science, Inc., Rolla, MO (US)

(72) Inventors: William J. Stone, Rogersville, MO (US); Joseph Demster, Clever, MO (US); Robert Christian Cox, Rolla, MO (US); Alex Bruce Johnson, Columbia, MO (US); Louis McCarthy, Rolla, MO (US)

(73) Assignee: Brewer Science, Inc., Rolla, MO (US)

( * ) Notice: Subject to any disclaimer, the term of this patent is extended or adjusted under 35 U.S.C. 154(b) by 0 days.

(21) Appl. No.: 16/045,241

(22) Filed: Jul. 25, 2018

(65) Prior Publication Data

US 2019/0036246 A1 Jan. 31, 2019

Related U.S. Application Data

(60) Provisional application No. 62/537,056, filed on Jul. 26, 2017.

(51) Int. Cl.
*H01R 13/502* (2006.01)
*H01R 12/59* (2011.01)
(Continued)

(52) U.S. Cl.
CPC ..... *H01R 12/592* (2013.01); *H01R 12/53* (2013.01); *H01R 12/65* (2013.01); *H01R 13/521* (2013.01); *H01R 13/5219* (2013.01)

(58) Field of Classification Search
CPC ..... H01R 13/5219; H01R 13/506; H01R 13/5812; H01R 12/79; H01R 23/662; H01R 2103/00; H01R 13/5216
(Continued)

(56) References Cited

U.S. PATENT DOCUMENTS 3,744,128 A * 7/1973 Fisher ..... H01R 13/6599 29/858
4,191,444 A * 3/1980 Smith ..... H01R 13/595 439/459

(Continued)

FOREIGN PATENT DOCUMENTS

JP 2004-241346 8/2004
WO 03/056665 7/2003

OTHER PUBLICATIONS

Molex Sealed Connector Families, printed Jun. 28, 2018, https://www.molex.com/molex/products/group?channel=products&key=sealed_connectors, 9 pages.

(Continued)

*Primary Examiner* — Thanh Tam T Le
(74) *Attorney, Agent, or Firm* — Hovey Williams LLP

(57) ABSTRACT

An environmentally sealed connector for connecting a spring-loaded terminal to a flexible circuit includes a spring-loaded terminal and a connector cap having a terminal cavity receiving a portion of the spring-loaded terminal therein in order to electrically couple the spring-loaded terminal to the flexible circuit. A connector base is releasably coupled to the connector cap and covers the terminal cavity and the portion of the spring-loaded terminal therein. An elastic member is disposed between the connector cap and the connector base in sealing engagement therewith and surrounds the terminal cavity and the portion of the spring-loaded terminal.

39 Claims, 13 Drawing Sheets

(51) Int. Cl.
*H01R 12/53* (2011.01)
*H01R 13/52* (2006.01)
*H01R 12/65* (2011.01)

(58) Field of Classification Search
USPC ..... 439/271, 459, 460, 492, 495, 497, 695, 439/696, 936
See application file for complete search history.

(56) References Cited

U.S. PATENT DOCUMENTS 4,335,932 A * 6/1982 Herrmann, Jr. ..... B29C 33/0016 174/541
4,345,223 A * 8/1982 Chien-Chun ..... H01R 13/713 315/3
4,352,540 A * 10/1982 Liu ..... H01R 13/512 439/696
4,526,432 A * 7/1985 Cronin ..... H01R 12/777 439/320
4,566,187 A * 1/1986 Chen ..... H01R 4/4872 29/857
4,629,276 A * 12/1986 Genaro ..... H01R 13/5841 439/449
5,183,420 A * 2/1993 Hollander ..... H01R 13/72 439/4
5,580,282 A * 12/1996 Paterek ..... H01R 13/521 439/271
5,591,041 A * 1/1997 Cecil, Jr. ..... H01R 13/639 439/352
6,039,596 A * 3/2000 Whiteman, Jr. ... H01R 13/5205 439/404
6,558,180 B2 * 5/2003 Nishimoto ..... H01R 9/223 439/271
6,848,930 B2 * 2/2005 Fukuda ..... H01R 13/6277 439/271
6,875,048 B2 4/2005 Lee
6,910,904 B2 * 6/2005 Herrick ..... F04B 39/121 439/271
7,059,901 B2 * 6/2006 Morita ..... H01R 13/5219 439/271
7,297,016 B1 * 11/2007 Tymkewicz ..... G01K 7/023 439/459
7,309,256 B2 12/2007 Alloway et al.
7,632,148 B1 * 12/2009 Kawamura ..... H01R 13/5221 439/607.41
7,928,825 B2 * 4/2011 Yang ..... H01R 13/7137 337/68
8,052,481 B2 * 11/2011 Azad ..... H01H 85/202 439/676
8,647,150 B2 * 2/2014 Fujiwara ..... H01R 13/5221 439/587
8,834,197 B2 * 9/2014 Wu ..... H01R 12/61 439/497
8,956,166 B2 * 2/2015 Ritner ..... H01R 12/79 439/84
10,211,552 B2 * 2/2019 Zhu ..... H01R 13/5833
10,283,917 B1 * 5/2019 Darr ..... B60R 16/0238
2003/0087544 A1 5/2003 Nogawa et al.
2014/0154916 A1 6/2014 Jinno et al.
2015/0244091 A1 8/2015 Naito

OTHER PUBLICATIONS

Switchcraft : Sealed Circular Waterproof Connectors, printed Jun. 28, 2018, http://www.switchcraft.com/Category.aspx?Parent=901, 2 pages.
Kinsun Industries Inc. Waterproof Connector, printed Jun. 28, 2018, https://www.kinsun.com/en/product-c68233/Waterproof-Connector-IP68.html, 5 pages.
AMP Sealed Connectors, Catalog 65481, Revised 01-00, Tyco Electronics AMP, https://www.connectorpeople.com/library/sealed_connectors/Tyco_AMP_Sealed_Connectors_65481.pdf, 80 pages.
International Search Report and Written Opinion dated Nov. 8, 2018 in corresponding PCT/US2018/043742 filed Jul. 25, 2018.
Machine Translation of JP2004-241346, 12 pages.

* cited by examiner

ENVIRONMENTALLY SEALED, REUSABLE CONNECTOR FOR PRINTED FLEXIBLE ELECTRONICS

CROSS REFERENCE TO RELATED APPLICATIONS

This patent application claims priority to and the benefit of U.S. Provisional Patent Application Ser. No. 62/537,056 filed Jul. 26, 2017, and entitled "ENVIRONMENTALLY SEALED, REUSABLE CONNECTOR FOR PRINTED FLEXIBLE ELECTRONICS," which is hereby incorporated by reference in its entirety.

BACKGROUND

The field of the disclosure relates generally to electrical connectors, and more particularly, to environmentally sealed, reusable connectors for flexible circuits.

At least some known connectors for flexible cables or circuits, such as flat flexible cables (FFCs), are not environmentally sealed and reusable. Typical sealed FFC connectors require an electrical terminal to be pressed into or otherwise connected to the FFC, a wire to be attached to the electrical terminal, and a permanent sealant (e.g., epoxy, plastic, resin, and the like) disposed or permanently affixed around the connector in an overmold process. By using, for example, an epoxy as the sealing agent, the FFC and connector cannot be reused. As such, there is a need for a reusable and an environmentally sealed connector for electrically coupling an FFC to one or more wires and that can withstand extreme outdoor environments, including submersion under water for extended periods.

BRIEF DESCRIPTION

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present disclosure will be apparent from the following detailed description of the embodiments and the accompanying drawing figures.

In one aspect, an environmentally sealed connector is provided. The environmentally sealed connector includes a spring-loaded terminal and a connector cap having a terminal cavity for receiving at least a portion of the spring-loaded terminal in order to electrically couple the spring-loaded terminal to a flexible circuit. Furthermore, the environmentally sealed connector includes a connector base releasably coupled to the connector cap. The connector base covers the terminal cavity and the portion of the spring-loaded terminal. Moreover, the environmentally sealed connector includes an elastic member disposed between the connector cap and the connector base. The elastic member is in sealing engagement therewith and surrounds the terminal cavity and the portion of the spring-loaded terminal.

In another aspect, another environmentally sealed connector is provided. The environmentally sealed connector includes a spring-loaded terminal having a conductive component coupled thereto, a connector base, a connector cap, and first and second elastic members. The connector base includes a terminal cavity for receiving at least a portion of the spring-loaded terminal in order to electrically couple the spring-loaded terminal to a flexible circuit. The connector base also includes a central cavity for receiving an electrically conductive element therein. The connector cap releasably is coupled to the connector base and covers the central cavity, terminal cavity, and the portion of the spring-loaded terminal. The first elastic member is disposed between the connector cap and the connector base. In addition, the first elastic member is in sealing engagement therewith and surrounds the terminal cavity and the portion of the spring-loaded terminal. The second elastic member is disposed between the connector cap and the connector base, and is in sealing engagement therewith, surrounding the central cavity.

In yet another aspect, a method for releasably coupling a flexible circuit to a connector is provided. The method includes removably inserting the flexible circuit into a connector housing. The flexible circuit contacts a spring-loaded terminal of the connector to form an electrical connection within the connector housing. The method also includes sealing around the electrical connection to provide ingress protection.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Figure 1:
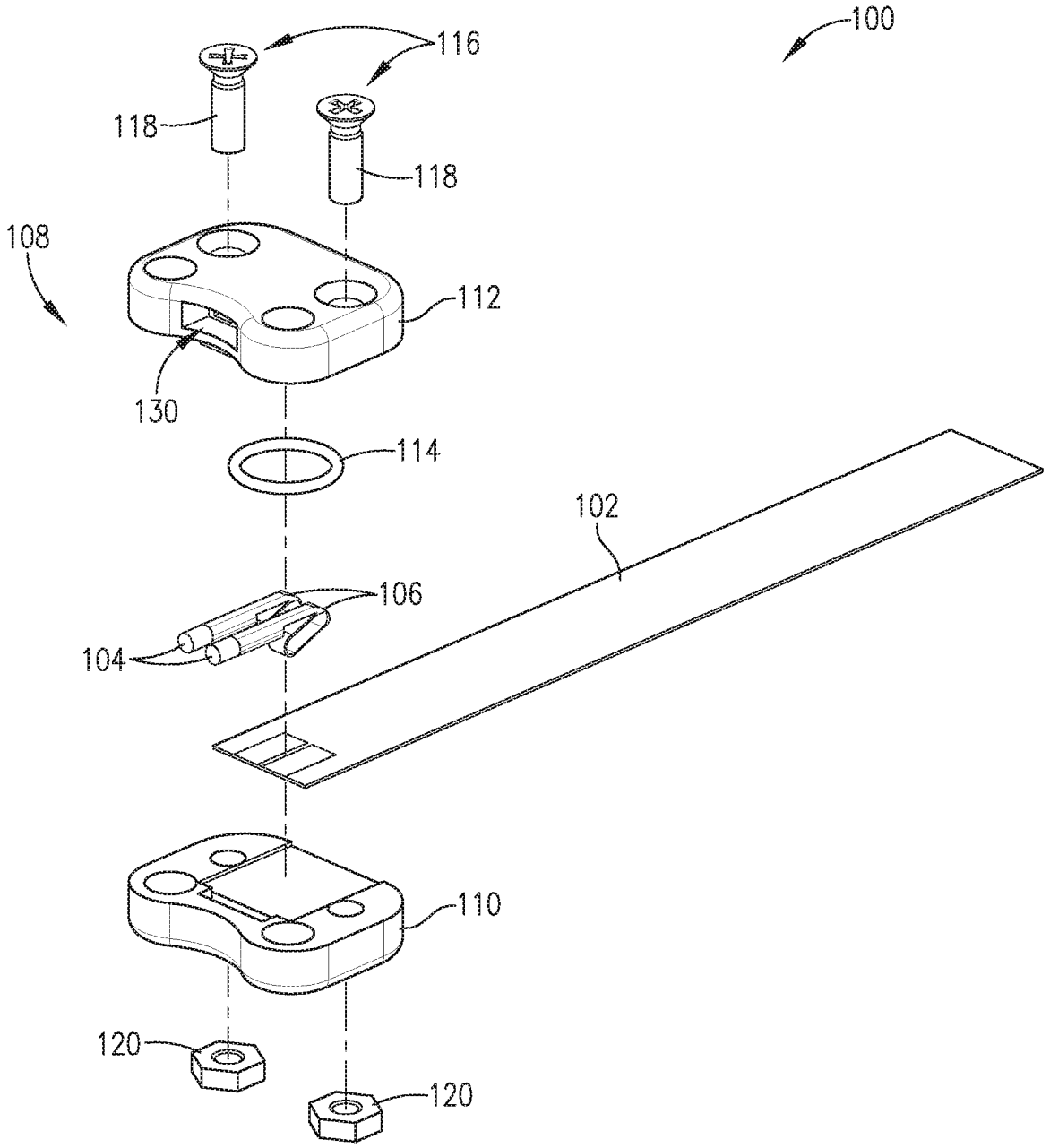
FIG. 1 is an exploded top perspective view of an exemplary flexible cable assembly, in accordance with one embodiment of the disclosure.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein. While the drawings do not necessarily provide exact dimensions or tolerances for the illustrated components or structures, the drawings are to scale with respect to the relationships between the components of the structures illustrated in the drawings.

DETAILED DESCRIPTION OF THE DISCLOSURE

The following detailed description of embodiments of the disclosure references the accompanying figures. The embodiments are intended to describe aspects of the disclosure in sufficient detail to enable those with ordinary skill in the art to practice the disclosure. The embodiments of the disclosure are illustrated by way of example and not by way of limitation. Other embodiments may be utilized, and changes may be made without departing from the scope of the claims. The following description is, therefore, not limiting. The scope of the present disclosure is defined only by the appended claims, along with the full scope of equivalents to which such claims are entitled.

In this description, references to "one embodiment," "an embodiment," or "embodiments" mean that the feature or features referred to are included in at least one embodiment of the disclosure. Separate references to "one embodiment," "an embodiment," or "embodiments" in this description do not necessarily refer to the same embodiment and are not mutually exclusive unless so stated. Specifically, a feature, component, action, step, etc. described in one embodiment may also be included in other embodiments but is not necessarily included. Thus, particular implementations of the present disclosure can include a variety of combinations and/or integrations of the embodiments described herein.

In the following specification and the claims, reference will be made to several terms, which shall be defined to have the following meanings. The singular forms "a," "an," and "the" include plural references unless the context clearly dictates otherwise. "Optional" or "optionally" means that the subsequently described feature, event, or circumstance may or may not be required or occur, and that the description includes instances with or without such element.

Approximating language, as used herein throughout the specification and the claims, may be applied to modify any quantitative representation that could permissibly vary without resulting in a change in the basic function to which it is related. Accordingly, a value modified by a term or terms, such as "about," "approximately," and "substantially" are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, directional references, such as, "top," "bottom," "front," "back," "side," and similar terms are used herein solely for convenience and should be understood only in relation to each other. For example, a component might in practice be oriented such that faces referred to herein as "top" and "bottom" are in practice sideways, angled, inverted, etc. relative to the chosen frame of reference.

Broadly, the present disclosure describes a reusable, resealable enclosure or connector that contains the contacts of an electrically conductive element (e.g., a flexible circuit or sensor), an O-ring or other elastic member, and one or more spring-loaded terminals to electrically connect the electrically conductive element to another conductor (e.g., one or more wires). This arrangement allows the electrically conductive element to be removed by opening or loosening the enclosure or connector.

Figure 2:
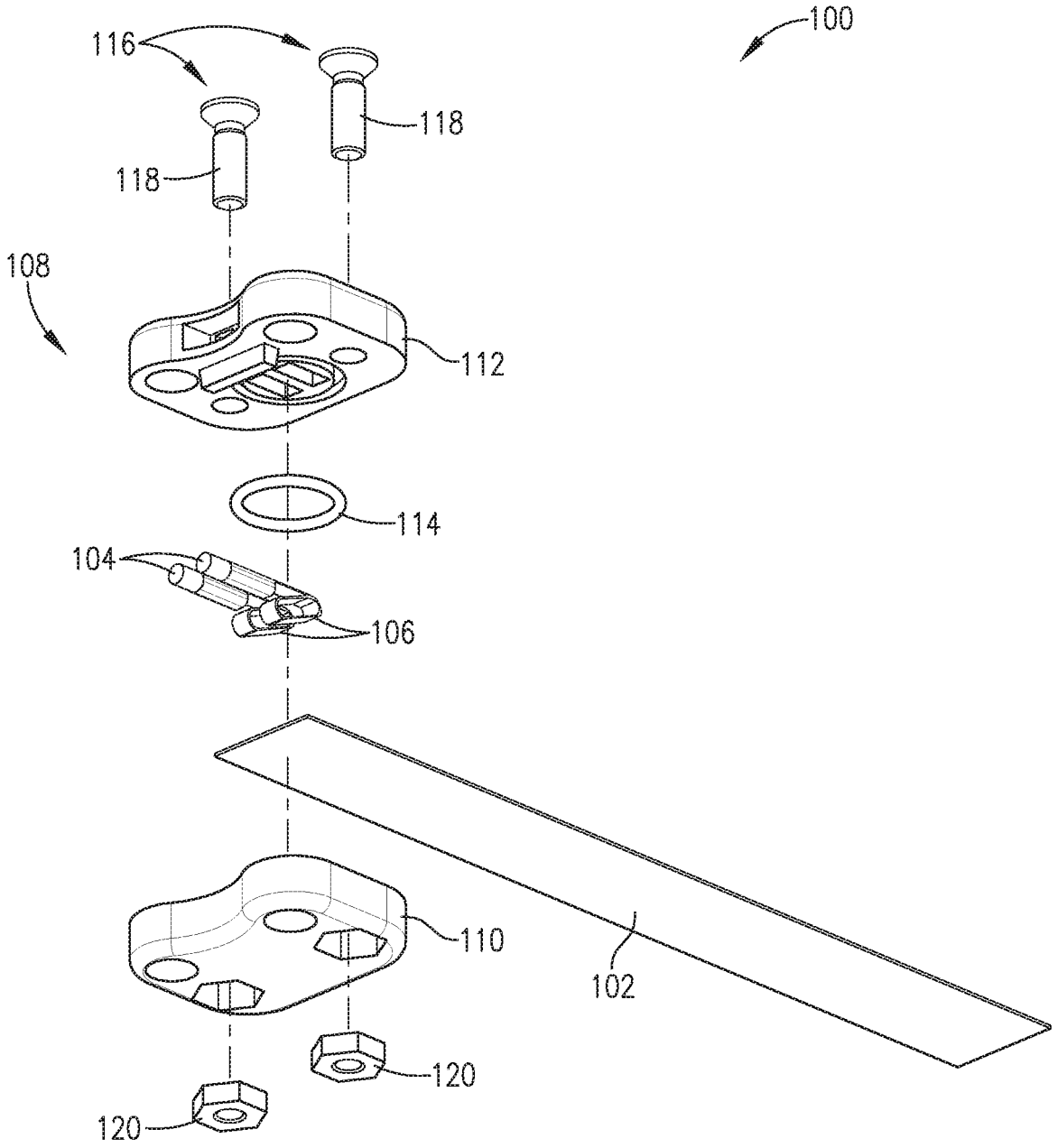
FIG. 2 is an exploded bottom perspective of the flexible cable assembly of FIG. 1.
Figure 3:
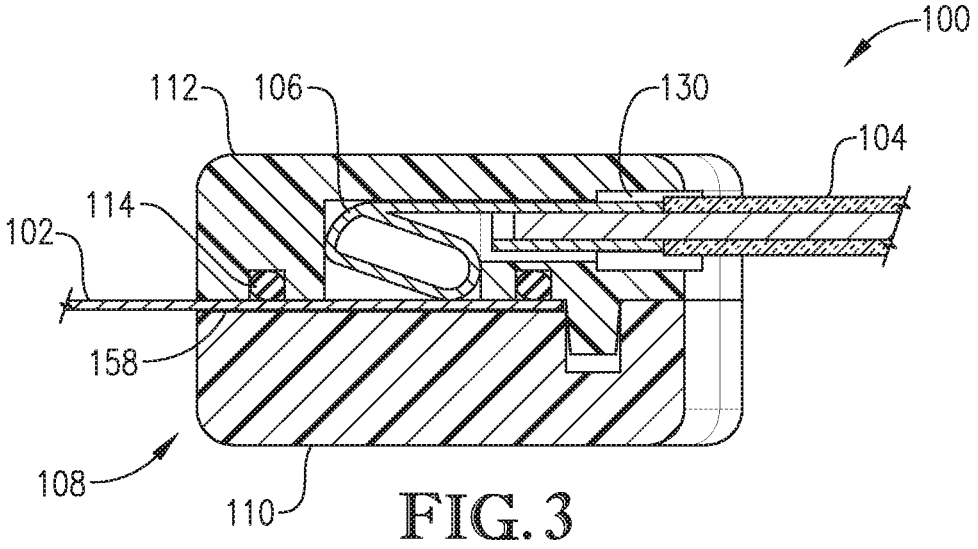
FIG. 3 is a sectional view of the flexible cable assembly of FIG. 1, illustrating an electrical connection enclosed therein.

FIG. 1 is an exploded top perspective view of an exemplary flexible cable assembly 100; FIG. 2 is an exploded bottom perspective of the flexible cable assembly 100; and FIG. 3 is a sectional view of the flexible cable assembly 100 illustrating the electrical connection enclosed therein. In the exemplary embodiment, the flexible cable assembly 100 includes a flexible circuit or cable (FC) 102 electrically coupled to one or more conductive components 104 via respective spring-loaded terminals 106 within an environmentally sealed, reusable connector 108. As used herein, the phrase "flexible circuit" and its abbreviation "FC" includes, for example, and without limitation, flat printed circuitry (FPC), flat flexible circuits or cables, sensors, flexible printed circuit boards, flex circuits, flex print, flexi-circuits, rigid flexible circuits, and flexible electronic components having one or more electrical connection portions proximate an end of the flexible circuit. Typical FCs consist of a thin insulating polymer film having conductive circuits formed thereon and are typically supplied with a thin polymer coating disposed over at least a portion of the conductive circuits to provide protection thereof. The FCs described herein may include one or more passive and/or active components integrated therein, thereby providing passive and/or active functions respectively. The conductive component 104 described herein includes, for example, and without limitation, wires, flexible printed circuit boards, printed non-wire components, and the like. In some embodiments, the conductive component 104 may include a wire coated, for example, with an insulating material, such as an insulating sheath or insulating film.

In the exemplary embodiment, the reusable connector 108 includes a connector base 110 and a connector cap 112 defining a connector housing, an elastic member 114, and one or more fastener assemblies 116. In the exemplary embodiment, the fastener assembly 116 includes a screw 118 and a nut 120 releasably secured to each other via threaded connection. Alternatively, the fastener assembly 116 may include rivets, bolts, pins, clamps, adhesive, and any other type of fastener that enables the connector 108 to function as described herein. In alternative embodiments, the one or more fastener assemblies 116 may be formed as part of the connector base 110 and/or the connector cap 112. In addition, the elastic member 114 may include, for example, a gasket, an O-ring, or a sealable foil to provide sealing engagement between the connector base 110 and the connector cap 112. The elastic member 114 may be fabricated from a resilient material including, for example, without limitation, perfluoro elastomers, Viton®, Extreme Viton® Type A, nitrile (Buna-N), hydrogenated nitrile, silicone rubber, silicone, fluorosilicone, ethylene propylene, butyl rubber, Neoprene®, urethane, Teflon®, styrene butadiene, natural rubber, acrylic rubber, and ethylene acrylic.

Each conductive component 104 (e.g., a wire, cable, etc.) may be electrically and mechanically coupled to a respective spring-loaded terminal 106 via a crimp connection, solder connection, or any other connection that enables the cable assembly 100 to function as described herein. As best shown in FIG. 3, the spring-loaded terminal 106 with the conductive component 104 coupled thereto, is inserted into the connector cap 112 as further described below. The spring-loaded terminal 106 expands after full insertion to facilitate retaining the spring-loaded terminal 106 and conductive component 104. Elastic member 114 is positioned within the connector cap 112, the FC 102 is positioned on the connector base 110, and the connector cap 112 is coupled to the connector base 110. More specifically, the connector cap 112 is coupled to the connector base 110 such that the elastic member 114 is compressed against the FC 102 and the spring-loaded terminals 106 are in electrical contact with the FC 102. As described in more detail below, the elastic member 114 surrounds the electrical connections between the FC 102 and the portion of the spring-loaded terminals 106 contacting the FC 102 such that the electrical connections are sealed from the outside environment. The connector cap 112 is releasably coupled to the connector base 110 via the one or more fastener assemblies 116. It will be appreciated that the position of the configuration of the connector 108 could be revised, i.e., the connector base 110 could contain the elastic member 114 and the spring-loaded terminals 106 and conductive components 104. The use of the elastic member 114 surrounding the electrical connection between the FC 102 and the spring-loaded terminals 106 is advantageous in that the sealed connector 108 does not utilize a permanent sealant (e.g., epoxy, plastic, resin, and the like) to encapsulate the electrical connection, therefore enabling the FC 102 to be removed and replaced in the reusable connector 108.

Figure 4:
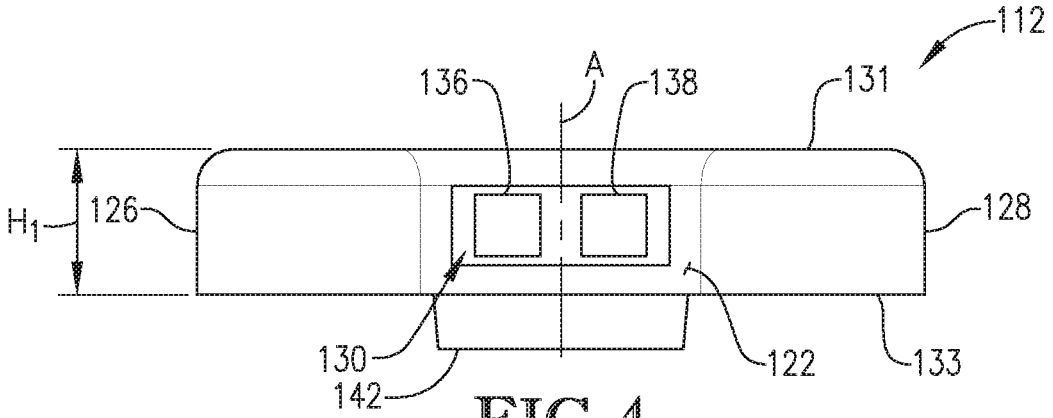
FIG. 4 is a front view of a connector cap of a connector of the flexible cable assembly of FIG. 1.
Figure 5:
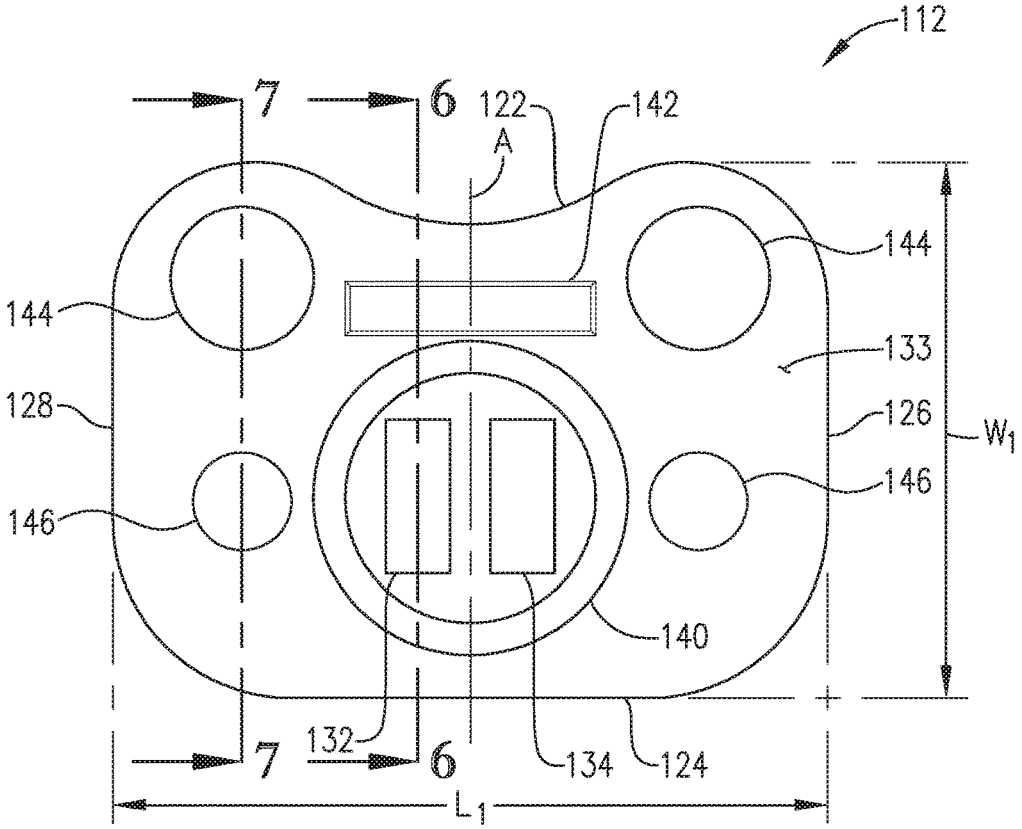
FIG. 5 is a bottom view of the connector cap of FIG. 4.
Figure 6:
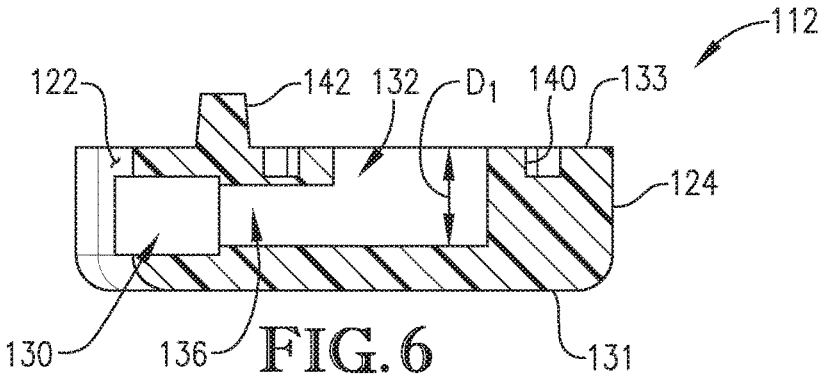
FIG. 6 is a section view of the connector cap taken along line 6-6 of FIG. 5.
Figure 7:
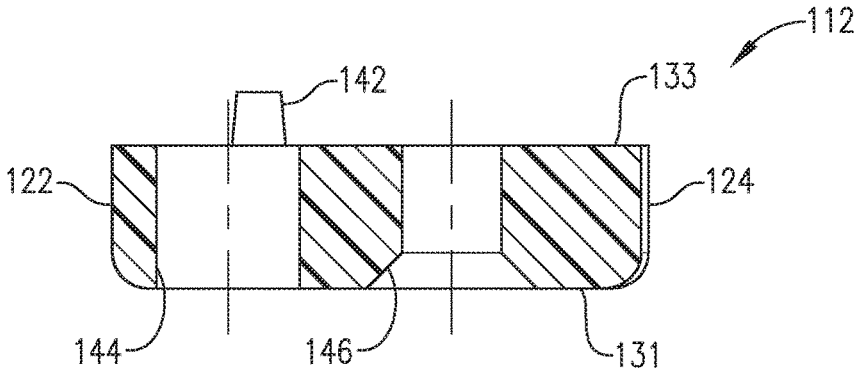
FIG. 7 is another section view of the connector cap taken along line 7-7 of FIG. 5.

The connector cap 112 is illustrated in more detail in FIGS. 4-7, where FIG. 4 is a front view of the connector cap 112, FIG. 5 is a bottom view, FIG. 6 is a section view taken along line 6-6 of FIG. 5, and FIG. 7 is another section view taken along line 7-7 of FIG. 5. In the exemplary embodiment, the connector cap 112 is substantially symmetrical with respect to a vertical line A, which, when viewed from the front, is substantially centered on the connector cap 112. Alternatively, the connector cap 112 may include features and/or elements that are not symmetrical with respect to each other. As described above, the terms top, bottom, front, rear, left, and right are used only for convenience to indicate relative positional relationships.

In the exemplary embodiment, the connector cap 112 may be fabricated as an integrally formed solid structure, for example, using an additive manufacturing process, such as, binder jetting, directed energy deposition, material extrusion, material jetting, powder bed fusion, sheet lamination, and vat photopolymerization. These processes may include technologies such as fused deposition modelling, direct metal laser melting, direct metal laser sintering, selective laser sintering, selective laser melting, electron beam melting, binder jet, and/or any other additive manufacturing technology. Alternatively, the connector cap 112 may be fabricated using a molding process. Accordingly, the features of the connector cap 112 described herein may have a draft angle associated with each wall and/or cavity to promote removal of the connector cap 112 from a mold.

The connector cap 112 may be fabricated from any generally rigid solid material or materials, including, but not limited to, metal, plastic, glass, and ceramic. Suitable metals may include, but are not limited to, aluminum, stainless steel, galvanized steel, alloys of tin, and combinations thereof. Suitable plastics may include, but are not limited to, one or more of acrylonitrile butadiene styrenes (ABS), poly lactic acids (PLA), styrenics, acrylics, polytetrafluoroethylenes (PTFE), perfluoroalkoxy alkanes (PFA), polyesters, polycarbonates (PET, PEN), polysulfones (PSU), polyether sulfones (PES), polyether imides (PEI), polyvinyl chlorides (PVC), chlorinated polyvinyl chlorides (CPVC), polyethylenes (PE, HDPE, LDPE, UPE), polypropylenes (PP), polyether etherketones (PEEK), fluorinated ethylene propylenes (FEP), ethylene tetrafluoroethylenes (ETFE), ethylene chlorotrifluoroethylenes (ECTFE), polyphenylene sulfides (PS), nylons, polyurethanses, and thermoplastics containing reinforcing fibers such as glasses, carbon fibers, and metal oxides. Suitable glasses may include, but are not limited to, quartz, soda lime, silicate, borosilicate, and combinations thereof. Suitable ceramics may include, but are not limited to, oxides of alumina, beryllia, ceria, and zirconia and nonoxides such as carbides, borides, nitrides, and silicides. Composite materials may also be used such as particulate-reinforced or fiber-reinforced oxides and nonoxides and combinations thereof. It is to be appreciated, however, that the connector cap 112 may be fabricated from any material that enables the connector 108 to function as described herein. Furthermore, the connector cap 112 may be fabricated by methods other than additive manufacturing and molding, including, e.g., machining, and therefore may not have a draft angle associated with the features as described herein.

In the exemplary embodiment, the connector cap 112 is a generally cuboid-shaped structure that broadly includes a curved front wall 122, a rear wall 124, a first end wall 126, and an opposing second end wall 128. While the connector cap 112 is described as being generally cuboid-shaped, it is noted that the connector cap 112 can be any shape that enables the connector 108 to function as described herein. As shown in FIG. 4, the connector cap 112 has a height "$H_1$" that is preferably in the range between and including about 3 millimeters (mm) and about 10 mm. In the exemplary embodiment, the height $H_1$ is more preferably in the range between and including about 4 mm and about 6 mm. With reference to FIG. 5, the connector cap 112 also has a length "$L_1$" that is preferably in the range between and including about 15 mm and about 50 mm. In the exemplary embodiment, the length $L_1$ is more preferably in the range between and including about 20 mm and about 30 mm. Furthermore, the connector cap 112 has a width "$W_1$" that is preferably in the range between and including about 15 mm and about 35 mm. In the exemplary embodiment, the width $W_1$ is more preferably in the range between and including about 15 mm and about 25 mm.

With reference to FIG. 4, a cable access hole 130 is defined in the front wall 122, generally centered between a top surface 131 and a bottom surface 133 of the connector cap 112 and that is substantially symmetrical with respect to vertical line A. The cable access hole 130 extends partially through the connector cap 112 a predefined depth and is configured to receive the conductive components 104 and spring-loaded terminals 106 therethrough (See, e.g., FIG. 3), and a potting material therein to facilitate sealing the spring-loaded terminals 106 from the outside environment. The potting material attaches to the conductive components 104 and the connector cap 112 to form a seal therebetween. In the exemplary embodiment, the cable access hole 130 is generally rectangular in shape, although it is contemplated that the cable access hole 130 can have any shape that enables the connector cap 112 to function as described herein.

With reference to FIG. 5, the connector cap 112 includes a first terminal cavity 132 and a second terminal cavity 134 that is substantially symmetrical to first terminal cavity 132 with respect to line A. Alternatively, the connector cap 112 may include any number of cavities that enable the connector cap 112 to function as described herein (See, e.g., FIG. 12). In the exemplary embodiment, the first and second terminal cavities 132 and 134 extend partially through the connector cap 112 to a depth "$D_1$," as best shown in FIG. 6. The first and second terminal cavities 132 and 134 are sized and shaped to receive at least a portion of a spring-loaded terminal 106, as illustrated in FIG. 3. The first terminal cavity 132 is coupled to the cable access hole 130 by a channel 136 defined within the connector cap 112. Furthermore, the second terminal cavity 134 is coupled to the cable access hole 130 by a channel 138. As shown in FIG. 4, the channels 136 and 138 are square in shape, although it is contemplated that the channels can include any perimeter shape that enables the connector cap 112 to function as described herein.

With reference back to FIG. 5, the bottom surface 133 (the mating surface) of the connector cap 112 includes a groove 140 that surrounds the first and second terminal cavities 132 and 134. The groove 140 is sized and shaped to receive the elastic member 114, as described further herein. In the exemplary embodiment, the groove 140 is substantially circular in shape, although other shapes are contemplated, including, for example, rectangular, polygonal, etc. As shown in FIG. 6, the groove 140 extends into the connector cap 112 a predetermined depth but does not extend into the channels 136 and 138. In some embodiments, it is contemplated that the groove 140 may extend into the channels 136 and 138. In addition, the groove 140 has a cross-sectional shape that is substantially rectangular. Alternatively, the cross-sectional shape of the groove 140 can be any shape that enables the connector 108 to function as described herein.

Extending away from the bottom surface 133 is a locating member 142, which is sized and shaped to physically engage with a slot 162 formed in the connector base 110, as best shown in FIG. 3. The locating member 142 is configured to locate the connector cap 112 with respect to the connector base 110 and to function as an insertion hard stop for the FC 102 to facilitate the electrical connection between the spring-loaded terminals 106 and the FC 102. In the exemplary embodiment, the locating member 142 is generally centered on the connector cap 112 with respect to the line A, as illustrated in FIGS. 4 and 5. The locating member 142 is generally an elongated member having a substantially rectangular shape with walls that taper inward as the locating member 142 extends away from the bottom surface 133. It is noted that the locating member 142 may have any shape so long as the slot 162 is complementary to facilitate locating the connector cap 112 with respect to the connector base 110. In the exemplary embodiment, the tapered walls of the locating member 142 engage upper edges of the slot 162 to facilitate controlled positioning of the connector cap 112.

With reference to FIG. 5, the exemplary connector cap 112 includes a substantially symmetrical pair of apertures 144 with respect to line A. The apertures 144 are generally positioned on either side of the locating member 142, proximate the front wall 122 of the connector cap 112. The apertures 144 are substantially circular in shape and extend through the connector cap 112, from the top surface 131 to the bottom surface 133. While the apertures 144 are illustrated as circular, in other embodiments, the apertures 144 may have other shapes, including, for example, and without limitation, rectangular, polygonal, and the like. The apertures 144 may be used to facilitate coupling the connector 108 to another structure and or additional connectors. It is noted that the connector cap 112 may include fewer or greater than two apertures 144.

In addition, the connector cap 112 includes a substantially symmetrical pair of fastener holes 146 with respect to line A. The fastener holes 146 are generally positioned on either side of the groove 140 and terminal cavities 132 and 134 to facilitate providing a compression force across the groove 140 and terminal cavities 132 and 134 when the connector 108 is assembled for use. Each fastener hole 146 is sized and shaped to receive a respective screw 118 (shown in FIGS. 1 and 2). In the exemplary embodiment, the fastener holes 146 are countersink holes for receiving a countersink faster, although other types of holes are contemplated, including, for example, counterbore holes. The fastener holes 146 extend through the connector cap 112, from the top surface 131 to the bottom surface 133. In the exemplary embodiment, the countersink configuration facilitates positioning the head of the screw 118 at or below the top surface 131 of the connector cap 112. It is noted that the connector cap 112 may include fewer or greater than two fastener holes 146.

Figure 8:
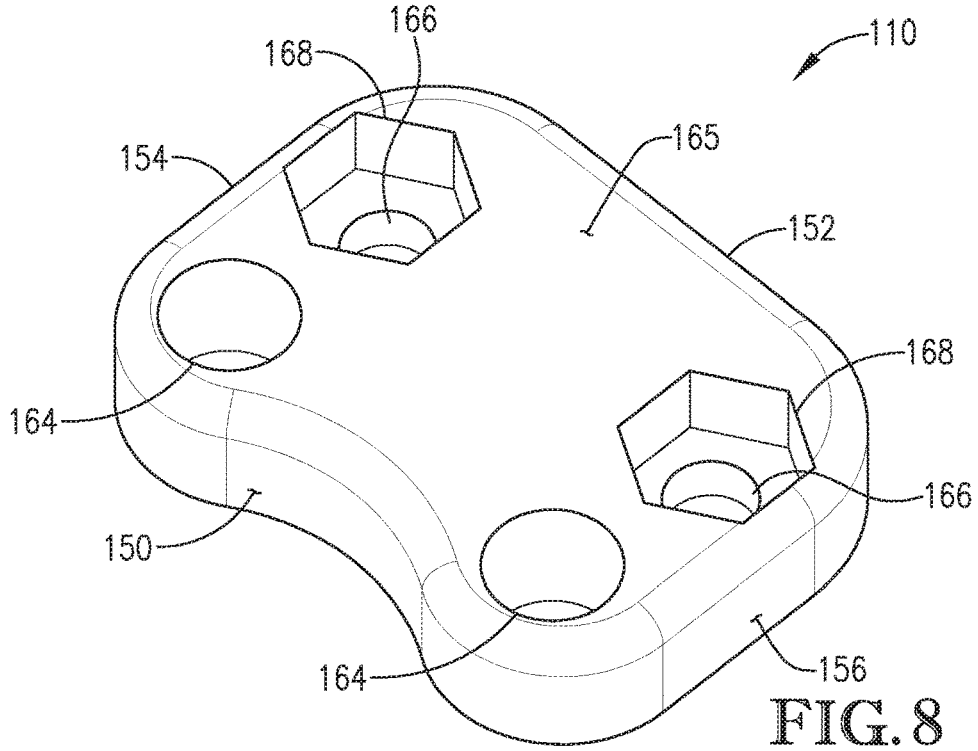
FIG. 8 is a bottom perspective view of a connector base of the connector of the flexible cable assembly of FIG. 1.
Figure 9:
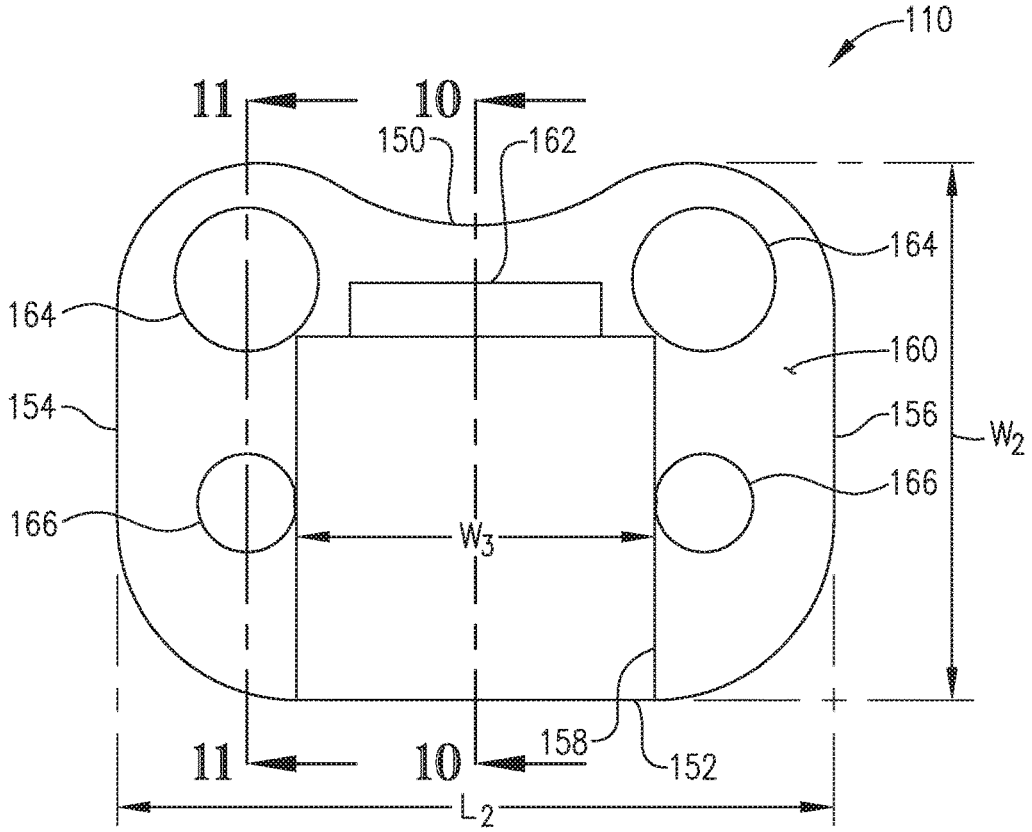
FIG. 9 is a top view of the connector base of FIG. 8.
Figure 10:
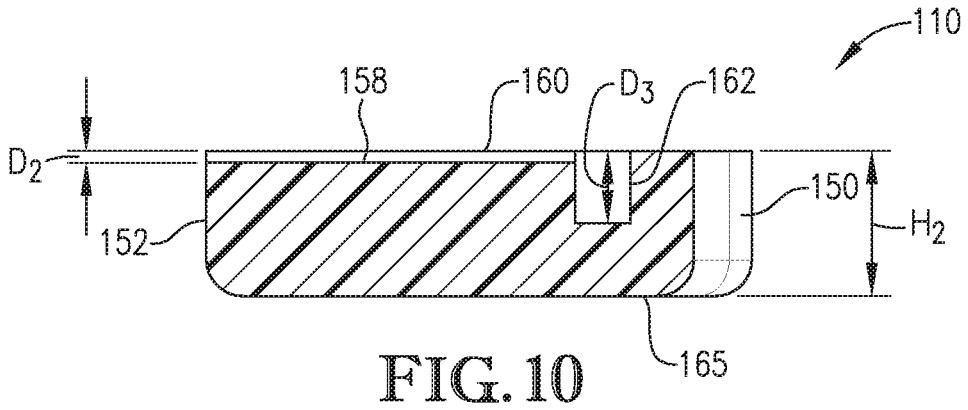
FIG. 10 is a section view of the connector base taken along line 10-10 of FIG. 9.
Figure 11:
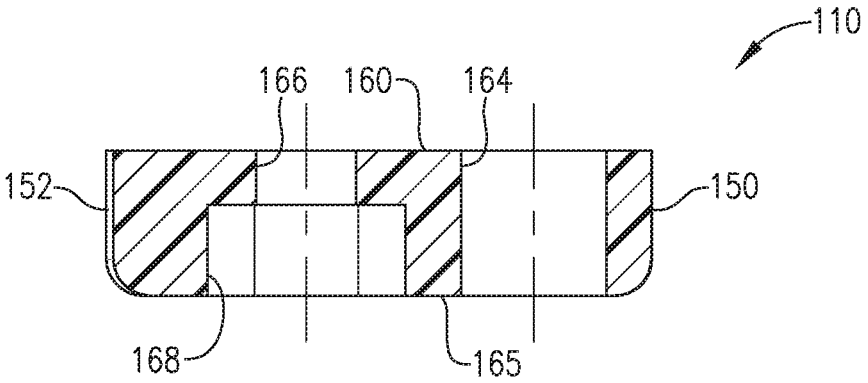
FIG. 11 is another section of the connector base taken along line 11-11 of FIG. 9.

The connector base 110 is illustrated in FIGS. 8-11, where FIG. 8 is a bottom perspective view of the connector base 110, FIG. 9 is a top view, FIG. 10 is a section view taken along line 10-10 of FIG. 9, and FIG. 11 is another section view taken along line 11-11 of FIG. 9. In the exemplary embodiment, the connector base 110 is substantially symmetrical with respect to the line 10-10 of FIG. 9, which is substantially centered on the connector base 110. Alternatively, the connector base 110 may include features and/or elements that are not symmetrical with respect to each other. As described above, the terms top, bottom, front, rear, left, and right are used only for convenience to indicate relative positional relationships.

In the exemplary embodiment, like the connector cap 112 described above, the connector base 110 may be fabricated as an integrally formed solid structure, for example, using any of the described additive manufacturing processes and/or technologies for the connector cap 112. Alternatively, the connector base 110 may be fabricated using a molding process. Accordingly, the features of the connector base 110 described herein may have a draft angle associated with each wall and/or cavity to promote removal of the connector base 110 from a mold. Furthermore, like the connector cap 112, the connector base 110 may be fabricated from any generally rigid solid material or materials, including, but not limited to the above described metals, plastics, glasses, ceramics, and/or combinations thereof. Composite materials may also be used such as particulate-reinforced or fiber-reinforced oxides and nonoxides and combinations thereof. It is to be appreciated, however, that the connector base 110 may be fabricated from any material that enables the connector 108 to function as described herein. Moreover, the connector base 110 may be fabricated by methods other than additive manufacturing and molding, including, e.g., machining, and therefore may not have a draft angle associated with the features as described herein.

In the exemplary embodiment, the connector base 110 has a perimeter shape that is generally complementary to that of the connector cap 112. More particularly, the connector base 110 is a generally cuboid-shaped structure that broadly includes a curved front wall 150, a rear wall 152, a first end wall 154, and an opposing second end wall 156. While the connector base 110 is described as being generally cuboid-shaped, it is noted that the connector base 110 can be any shape that enables the connector 108 to function as described herein. As shown in FIG. 10, the connector base 110 has a height "$H_2$" that is preferably in the range between and including about 3 mm and about 10 mm. In the exemplary embodiment, the height $H_2$ is more preferably in the range between and including about 4 mm and about 6 mm. With reference to FIG. 9, the connector base 110 also has a length "$L_2$" that is preferably in the range between and including about 15 mm and about 50 mm. In the exemplary embodiment, the length $L_2$ is more preferably in the range between and including about 20 mm and about 30 mm. Furthermore, the connector base 110 has a width "$W_2$" that is preferably in the range between and including about 15 mm and about 35 mm. In the exemplary embodiment, the width $W_2$ is more preferably in the range between and including about 15 mm and about 25 mm.

With reference to FIG. 9, the connector base 110 includes an alignment channel 158 defined in a top surface 160 (the mating surface) of the connector base 110 for aligning the one or more electrical connection portions of the FC 102 with the spring-loaded terminals 106. In the exemplary embodiment, the alignment channel 158 has a width "$W_3$" that is slightly larger than a width of the FC 102. In addition, as best shown in FIG. 10, the alignment channel 158 extends partially through the connector base 110 to a depth "$D_2$," that is slightly larger than a thickness of the FC 102. As such, the alignment channel 158 is sized and shaped to receive at least a portion of the FC 102, as illustrated in FIG. 3. The alignment channel 158 extends from the rear wall 152 of the connector base 110 to a slot 162 defined in the top surface 160, as illustrated in FIGS. 9 and 10.

In the exemplary embodiment, the slot 162 sized and shaped to engage with the locating member 142 of the connector cap 112 (shown in FIGS. 4-7), as described above. The slot 162 is configured to locate the connector base 110 with respect to the connector cap 112 to facilitate the electrical connection between the spring-loaded terminals 106 and the FC 102. In the exemplary embodiment, the slot 162 is generally centered on the connector base 110 with respect to the line 10-10, as illustrated in FIG. 9. The slot 162 is generally an elongate slot having a substantially rectangular shape. It is noted that the slot 162 may have any shape so long as the locating member 142 is complementary to facilitate locating the connector base 110 with respect to the connector cap 112. The slot 162 has a predetermined depth "$D_3$" configured to receive the locating member 142 such that the top surface 160 of the connector base 110 may engage in face-to-face contact with the bottom surface 133 of the connector cap 112 (shown in FIG. 5).

With reference to FIGS. 8, 9, and 11, the exemplary connector base 110 includes a substantially symmetrical pair of apertures 164 with respect to line 10-10. The apertures 164 are generally positioned on either side of the slot 162, proximate the front wall 150 of the connector base 110. The apertures 164 are substantially circular in shape and extend through the connector base 110, from a bottom surface 165 to the top surface 160. While the apertures 164 are illustrated as circular, in other embodiments, the apertures 164 may have other shapes, including, for example, and without limitation, rectangular, polygonal, and the like. The apertures 164 are sized, shaped, and positioned to be substantially complementary to the apertures 144 of the connector cap 112 and may be used to facilitate coupling the connector 108 to another structure and or additional connectors. In one embodiment, the apertures 164 and coaxial with the apertures 144 of the connector cap 112. It is noted that the connector base 110 may include fewer or greater than two apertures 164.

In addition, the connector base 110 includes a substantially symmetrical pair of fastener holes 166 with respect to line 10-10. The fastener holes 166 are generally positioned on either side of the alignment channel 158 proximate the rear wall 152 to facilitate providing a compression force across the FC 102 when the connector 108 is assembled for use. Each fastener hole 166 is sized and shaped to receive a respective screw 118 (shown in FIGS. 1 and 2) therethrough. As shown in FIGS. 8 and 11, the fastener holes 166 include a counterbored cavity 168 defined in the bottom surface 165. Each counterbored cavity 168 is formed substantially concentric with a respective fastener hole 166. In the exemplary embodiment, the counterbored cavity 168 is sized and shaped to receive a nut 120 (shown in FIGS. 1 and 2) of the fastener assembly 116 therein. The counterbored cavity 168 may be sized to provide an interference fit to facilitate securing the nut 120 to the connector base 110. In other embodiments, the fit may be a slip fit or any other fit that enables the connector base 110 to function as described herein. Additionally or alternatively, the nut 120 may be coupled to the connector base 110 via the counterbored cavity 168 through use of a glue or adhesive. In some embodiments, the counterbored cavity 168 may have a different shape configured to receive a different type of component of the fastener assembly 116, or the counterbored cavity 168 may be omitted entirely. It is noted that the connector base 110 may include fewer or greater than two fastener holes 166.

Figure 12:
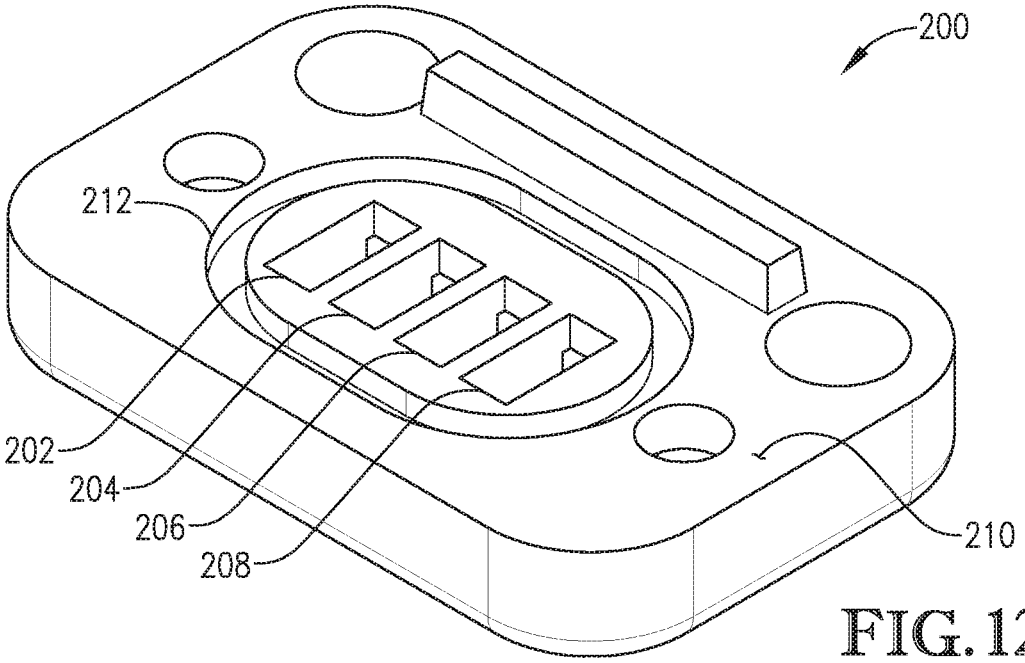
FIG. 12 is a perspective view of a four-position connector cap that may be used with the connector of the flexible cable assembly shown in FIG. 1.

FIG. 12 is a perspective view of a four-position connector cap 200 that may be used with the connector 108. The four-position connector cap 200 is fabricated substantially similar to the connector cap 112 illustrated in FIGS. 4-7, and as such, only the differences will be described below. The four-position connector cap 200 includes four spring-terminal cavities: a first cavity 202, a second cavity 204, a third cavity 206, and a fourth cavity 208. In the exemplary embodiment, the cavities 202, 204, 206, and 208 extend partially through the four-position connector cap 200 to a predefined depth, for example, the depth "$D_1$," as shown in FIG. 6. The cavities 202, 204, 206, and 208 are sized and shaped substantially similar to the first and second terminal cavities 132 and 134 of the connector cap 112 to receive at least a portion of a spring-loaded terminal 106, as illustrated in FIG. 3. Like the connector cap 112, the cavities 202, 204, 206, and 208 are coupled to a sealing cavity (not shown) by a respective channel (not shown) defined within the four-position connector cap 200.

A bottom surface 210 of the four-position connector cap 200 includes a groove 212 that surrounds the cavities 202, 204, 206, and 208. The groove 212 is sized and shaped to receive an elastic member, such as the elastic member 114. The groove 212 is generally annular-shaped. The term "annular," as used herein, is not limited to the description of circular ring-shaped openings. Rather, it is contemplated that annular shapes include, for example, and without limitation, shapes that are round, polygonal, rectangular, oval, and/or racetrack-like with two generally parallel sides joined by rounded ends. As shown in FIG. 12, the groove 212 extends into the four-position connector cap 200 a predetermined depth. In addition, the groove 212 has a cross-sectional shape that is substantially rectangular. Alternatively, the cross-sectional shape of the groove 212 can be any shape that enables the connector 108 to function as described herein.

Figure 13:
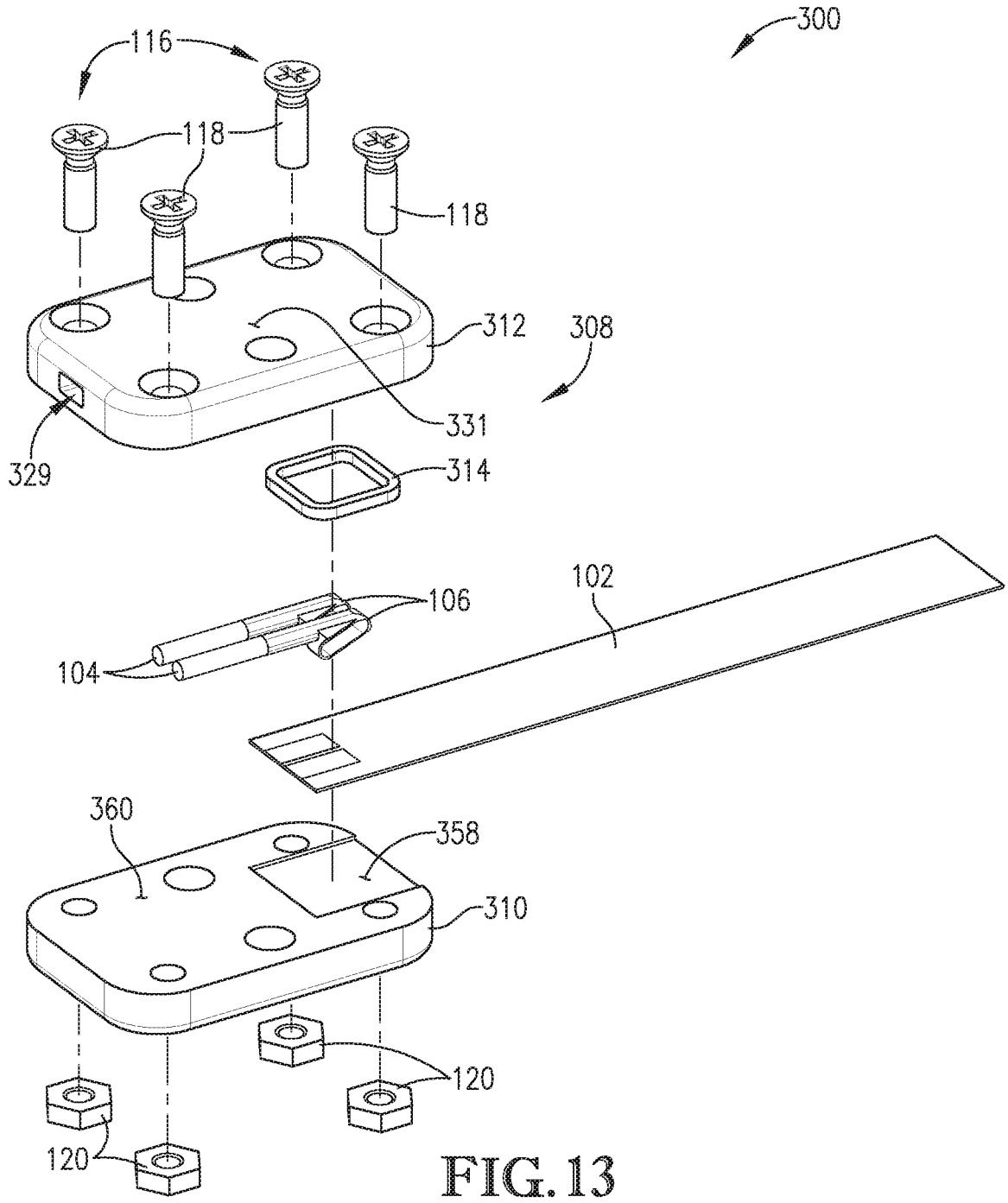
FIG. 13 is an exploded top perspective view of another flexible cable assembly.
Figure 14:
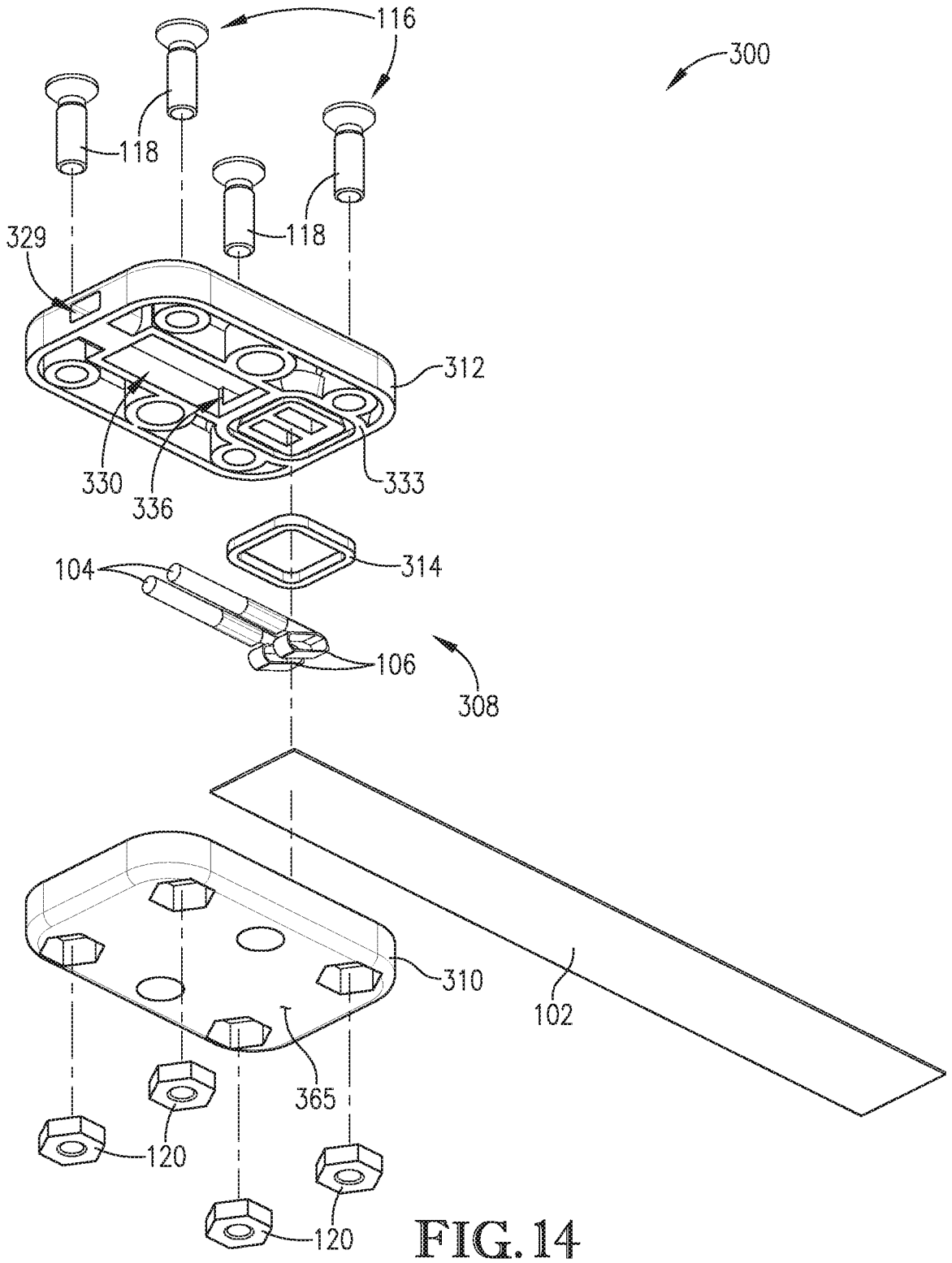
FIG. 14 is an exploded bottom perspective of the flexible cable assembly of FIG. 13.

FIG. 13 is an exploded top perspective view of an exemplary flexible cable assembly 300 and FIG. 14 is an exploded bottom perspective of the flexible cable assembly 300. In the exemplary embodiment, the cable assembly 300 includes the flexible circuit or cable (FC) 102 electrically coupled to one or more conductive components 104 via respective spring-loaded terminals 106 within an environmentally sealed connector 308.

In the exemplary embodiment, the connector 308 includes a connector base 310 and a connector cap 312 defining a connector housing, an elastic member 314, and one or more fastener assemblies 116, including the screw 118 and the nut 120 releasably secured to each other via threaded connection. In alternative embodiments, the one or more fastener assemblies 116 may be formed as part of the connector base 310 and/or the connector cap 312. In addition, the elastic member 314 may include, for example, a gasket, an O-ring, or a sealable foil to provide sealing engagement between the connector base 310 and the connector cap 312. The elastic member 314 may be fabricated from a resilient material including, for example, without limitation, perfluoro elastomers, Viton®, Extreme Viton® Type A, nitrile (Buna-N), hydrogenated nitrile, silicone rubber, silicone, fluorosilicone, ethylene propylene, butyl rubber, Neoprene®, urethane, Teflon®, styrene butadiene, natural rubber, acrylic rubber, and ethylene acrylic.

Like the cable assembly 100 described above, the spring-loaded terminal 106 with the conductive component 104 coupled thereto, is inserted into the connector cap 312 as further described below. The spring-loaded terminal 106 expands after full insertion to facilitate retaining the spring-loaded terminal 106 and conductive component 104. The elastic member 314 is positioned within the connector cap 312, the FC 102 is positioned on the connector base 310, and the connector cap 312 is coupled to the connector base 310. More specifically, the connector cap 312 is coupled to the connector base 310 such that the elastic member 314 is compressed against the FC 102 and a portion of the spring-loaded terminals 106 are in electrical contact with the FC 102. As described in more detail below, the elastic member 314 surrounds the electrical connections between the FC 102 and the portion of the spring-loaded terminals 106 contacting the FC 102 such that the electrical connections are sealed from the outside environment. The connector cap 312 is releasably coupled to the connector base 310 via the one or more fastener assemblies 116. It will be appreciated that the position of the configuration of the connector 308 could be revised, i.e., the connector base 310 could contain the elastic member 314 and the spring-loaded terminals 106 and conductive components 104.

Figure 15:
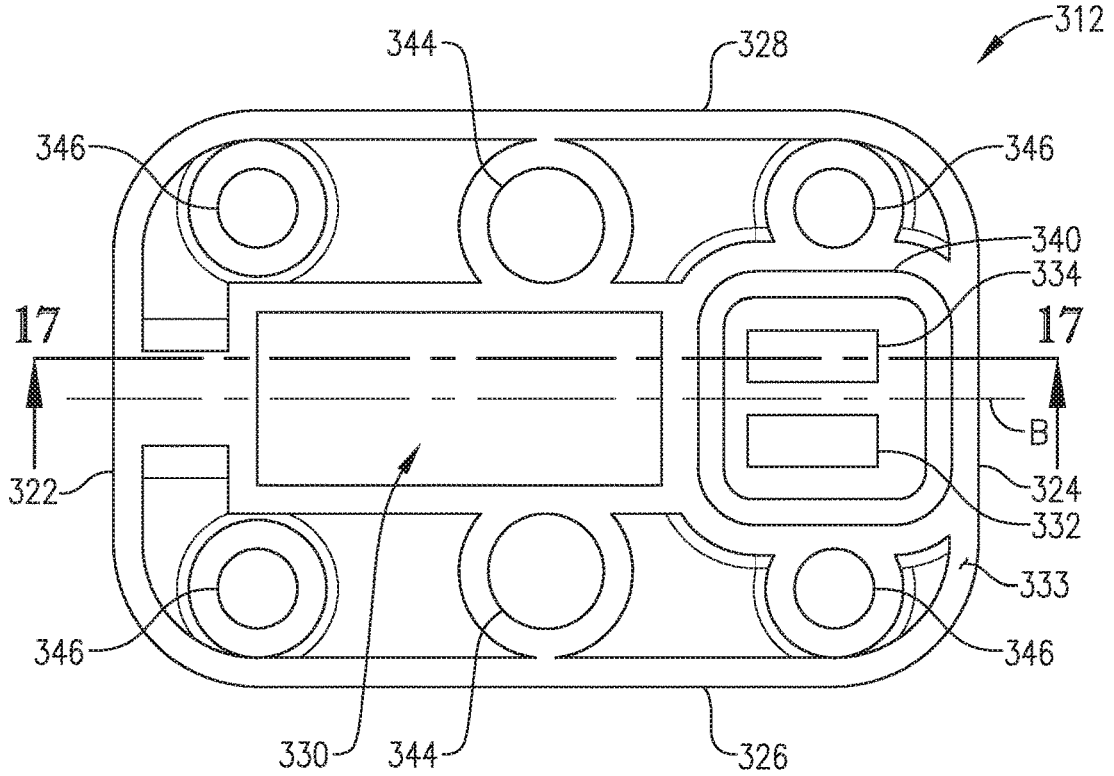
FIG. 15 is a bottom view of a connector cap of a connector of the flexible cable assembly shown in FIG. 13.
Figure 16:
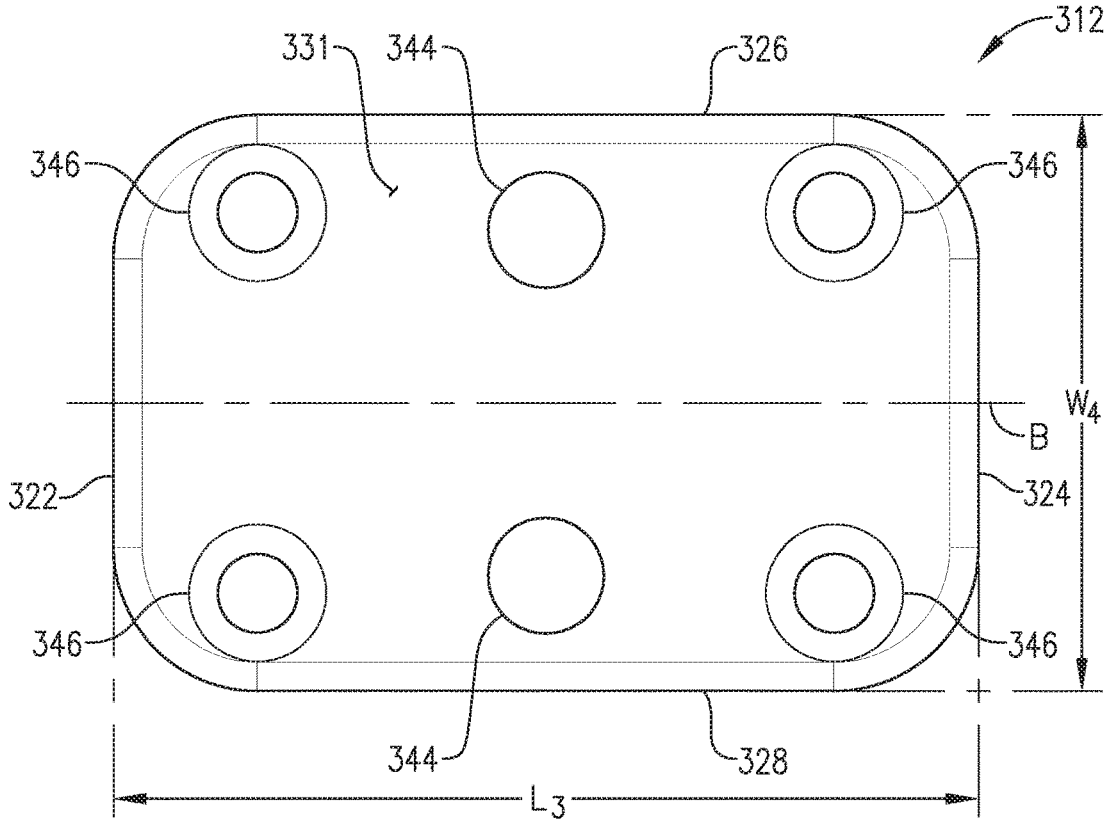
FIG. 16 is a top view of the connector cap of FIG. 15.
Figure 17:
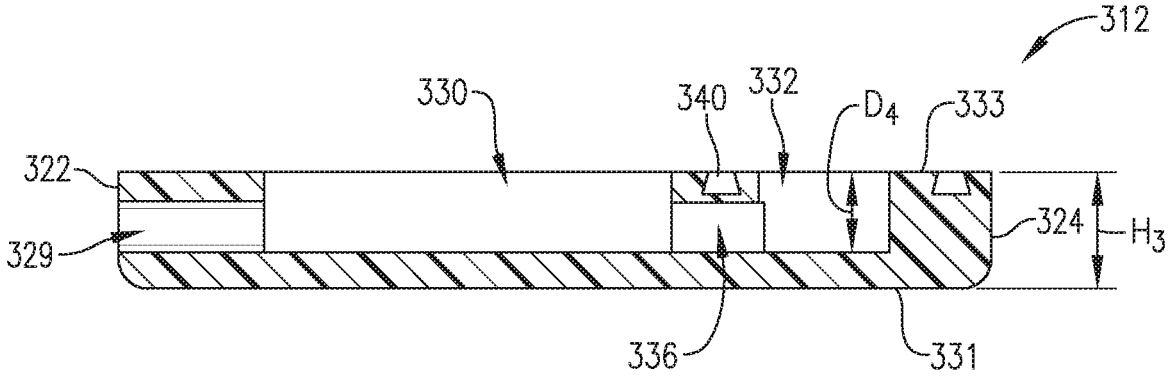
FIG. 17 is a section view of the connector cap taken along line 17-17 of FIG. 15.

The connector cap 312 is illustrated in more detail in FIGS. 15-17, where FIG. 15 is a bottom view of the connector cap 312, FIG. 16 is a top view, and FIG. 17 is a section view taken along line 17-17 of FIG. 15. In the exemplary embodiment, the connector cap 312 is substantially symmetrical with respect to a horizontal line B, which is substantially centered on the connector cap 312. Alternatively, the connector cap 312 may include features and/or elements that are not symmetrical with respect to each other. As described above, the terms top, bottom, front, rear, left, and right are used only for convenience to indicate relative positional relationships.

In the exemplary embodiment, like the connector cap 112 described above, the connector cap 312 may be fabricated as an integrally formed solid structure, for example, using any of the described additive manufacturing processes and/or technologies for the connector cap 112. Alternatively, the connector cap 312 may be fabricated using a molding process. Accordingly, the features of the connector cap 312 described herein may have a draft angle associated with each wall and/or cavity to promote removal of the connector cap 312 from a mold. Furthermore, like the connector cap 112, the connector cap 312 may be fabricated from any generally rigid solid material or materials, including, but not limited to the above described metals, plastics, glasses, ceramics, and/or combinations thereof. Composite materials may also be used such as particulate-reinforced or fiber-reinforced oxides and nonoxides and combinations thereof. It is to be appreciated, however, that the connector cap 312 may be fabricated from any material that enables the connector 308 to function as described herein. Moreover, the connector cap 312 may be fabricated by methods other than additive manufacturing and molding, including, e.g., machining, and therefore may not have a draft angle associated with the features as described herein.

In the exemplary embodiment, the connector cap 312 is a generally cuboid-shaped structure that broadly includes a front wall 322, a rear wall 324, a first sidewall 326, and an opposing second sidewall 328. While the connector cap 312 is described as being generally cuboid-shaped, it is noted that the connector cap 312 can be any shape that enables the connector 308 to function as described herein. As shown in FIG. 17, the connector cap 312 has a height "$H_3$" that is preferably in the range between and including about 3 millimeters (mm) and about 10 mm. In the exemplary embodiment, the height $H_3$ is more preferably in the range between and including about 4 mm and about 6 mm. With reference to FIG. 16. the connector cap 312 also has a length "$L_3$" that is preferably in the range between and including about 15 mm and about 50 mm. In the exemplary embodiment, the length $L_3$ is more preferably in the range between and including about 25 mm and about 35 mm. Furthermore, the connector cap 312 has a width "$W_4$" that is preferably in the range between and including about 15 mm and about 35 mm. In the exemplary embodiment, the width $W_4$ is more preferably in the range between and including about 15 mm and about 25 mm.

An internal sealing cavity 330 is defined within the connector cap 312 and is coupled to a cable access hole 329 defined in the front wall 322. The cable access hole 329 is generally centered between a top surface 331 and a bottom surface 333 of the connector cap 312 and that is substantially symmetrical with respect to horizontal line B. The internal sealing cavity 330 in generally centered about line B and extends from the bottom surface 333 partially through the connector cap 312 a predefined depth. The internal sealing cavity 330 is configured to receive the conductive components 104 and spring-loaded terminals 106 therethrough and a potting material therein to facilitate sealing the spring-loaded terminals 106 from the outside environment. In the exemplary embodiment, the sealing cavity 330 is generally rectangular in shape, although it is contemplated that the sealing cavity 330 can have any shape that enables the connector cap 312 to function as described herein.

With reference to FIG. 15, the connector cap 312 includes a first terminal cavity 332 and a second terminal cavity 334 that is substantially symmetrical to the first terminal cavity 332 with respect to line B. Alternatively, the connector cap 312 may include any number of cavities that enable the connector cap 312 to function as described herein (See, e.g., FIG. 12). In the exemplary embodiment, the first and second terminal cavities 332 and 334 extend partially through the connector cap 312 to a depth "$D_4$," as best shown in FIG. 17. The first and second terminal cavities 332 and 334 are sized and shaped to receive at least a portion of a spring-loaded terminal 106, as illustrated in FIG. 3. The first and second terminal cavities 332 and 334 are coupled to the sealing cavity 330 by a channel 336 defined within the connector cap 312. As shown in FIG. 14, the channel 336 is generally rectangular in shape, although it is contemplated that the channel can include any shape that enables the connector cap 312 to function as described herein.

With reference back to FIG. 15, the bottom surface 333 of the connector cap 312 includes a groove 340 that surrounds the first and second terminal cavities 332 and 334. The groove 340 is sized and shaped to receive the elastic member 314 therein, as described further herein. In the exemplary embodiment, the groove 340 is generally annular-shaped, although other shapes are contemplated, including, for example, circular, polygonal, etc. As shown in FIG. 17, the groove 340 extends into the connector cap 312 a predetermined depth but does not extend into the channel 336, although in some embodiments, it is contemplated that the groove 340 may extend into the channel 336. In addition, the groove 340 has a cross-sectional shape that is generally rectangular with slightly inwardly-tapered sidewalls to facilitate retaining the elastic member 314 therein. Alternatively, the cross-sectional shape of the groove 340 can be any shape that enables the connector 308 to function as described herein.

The exemplary connector cap 312 includes a substantially symmetrical pair of apertures 344 with respect to line B. The apertures 344 are generally positioned centrally on the connector cap 312 along the line B. The apertures 344 are substantially circular in shape and extend through the connector cap 312, from the top surface 331 to the bottom surface 333. While the apertures 344 are illustrated as circular, in other embodiments, the apertures 344 may have other shapes, including, for example, and without limitation, rectangular, polygonal, and the like. The apertures 344 may be used to facilitate coupling the connector 308 to another structure and or additional connectors.

In addition, the connector cap 312 includes a substantially symmetrical set of fastener holes 346 with respect to line B. The fastener holes 346 are generally positioned proximate the corners of the connector cap 312, with one pair positioned on either side of the groove 340 and terminal cavities 332 and 334 to facilitate providing a compression force across the groove 340 and terminal cavities 332 and 334 when the connector 308 is assembled for use. Each fastener hole 346 is sized and shaped to receive a respective screw 118 (shown in FIGS. 13 and 14). In the exemplary embodiment, the fastener holes 346 are countersink holes for receiving a countersink faster, although other types of holes are contemplated, including, for example, counterbore holes. The fastener holes 346 extend through the connector cap 312, from the top surface 331 to the bottom surface 333. In the exemplary embodiment, the countersink configuration facilitates positioning the head of the screw 118 at or below the top surface 331 of the connector cap 312.

Figure 18:
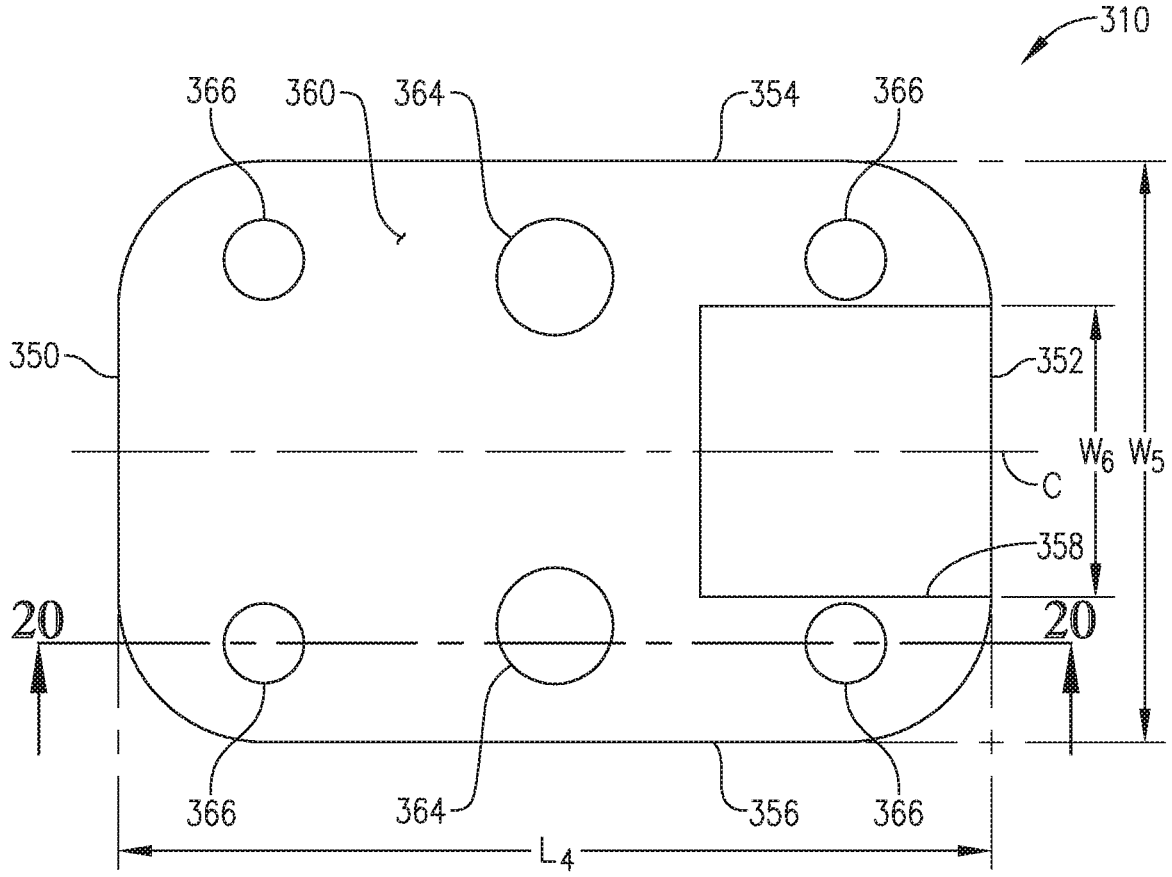
FIG. 18 is a top view of a connector base of the connector of the flexible cable assembly shown in FIG. 13.
Figure 19:
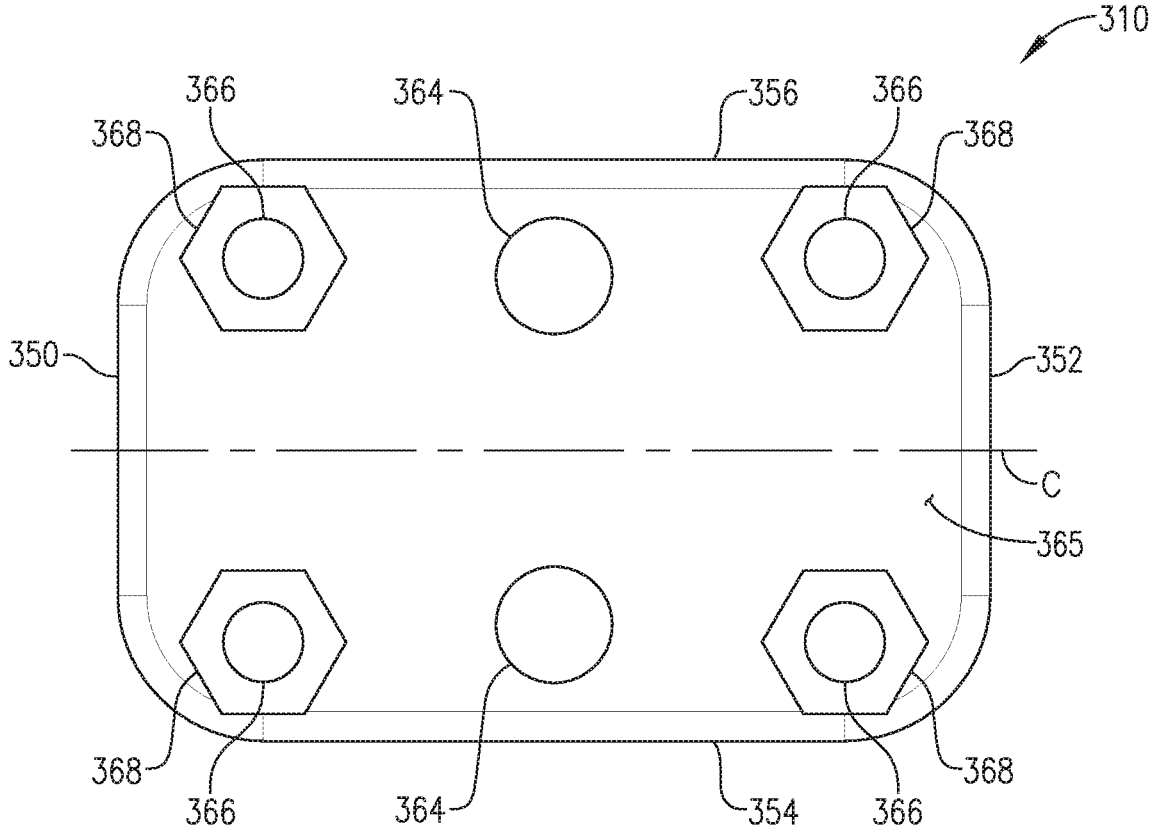
FIG. 19 is a bottom view of the connector base of FIG. 18.
Figure 20:
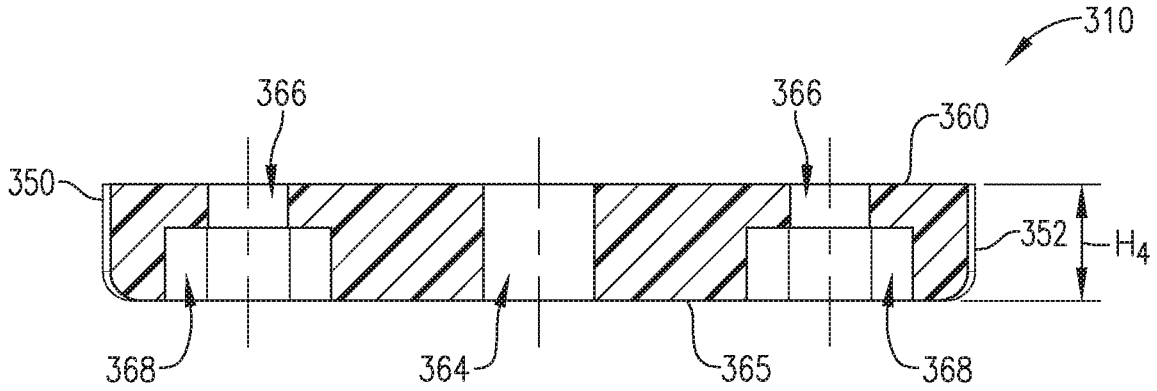
FIG. 20 is a section view of the connector base taken along line 20-20 of FIG. 18.

The connector base 310 is illustrated in FIGS. 18-20, where FIG. 18 is a top view of the connector base 310, FIG. 19 is a bottom view, and FIG. 20 is a section view taken along line 20-20 of FIG. 18. In the exemplary embodiment, the connector base 310 is substantially symmetrical with respect to a horizontal line C, which is substantially centered on the connector base 310. Alternatively, the connector base 310 may include features and/or elements that are not symmetrical with respect to each other. As described above, the terms top, bottom, front, rear, left, and right are used only for convenience to indicate relative positional relationships.

In the exemplary embodiment, like the connector cap 312 described above, the connector base 310 may be fabricated as an integrally formed solid structure, for example, using any of the described additive manufacturing processes and/or technologies for the connector cap 312. Alternatively, the connector base 310 may be fabricated using a molding process. Accordingly, the features of the connector base 310 described herein may have a draft angle associated with each wall and/or cavity to promote removal of the connector base 310 from a mold. Furthermore, like the connector cap 312, the connector base 310 may be fabricated from any generally rigid solid material or materials, including, but not limited to the above described metals, plastics, glasses, ceramics, and/or combinations thereof. Composite materials may also be used such as particulate-reinforced or fiber-reinforced oxides and nonoxides and combinations thereof. It is to be appreciated, however, that the connector base 310 may be fabricated from any material that enables the connector 308 to function as described herein. Moreover, the connector base 310 may be fabricated by methods other than additive manufacturing and molding, including, e.g., machining, and therefore may not have a draft angle associated with the features as described herein.

In the exemplary embodiment, the connector base 110 has a perimeter shape that is generally complementary to that of the connector cap 312. More particularly, the connector base 310 is a generally cuboid-shaped structure that broadly includes a front wall 350, a rear wall 352, a first sidewall 354, and an opposing second sidewall 356. While the connector base 310 is described as being generally cuboid-shaped, it is noted that the connector base 310 can be any shape that enables the connector 308 to function as described herein. As shown in FIG. 20, the connector base 310 has a height "$H_4$" that is preferably in the range between and including about 3 mm and about 10 mm. In the exemplary embodiment, the height $H_4$ is more preferably in the range between and including about 4 mm and about 6 mm. With reference to FIG. 18, the connector base 310 also has a length "$L_4$" that is preferably in the range between and including about 15 mm and about 50 mm. In the exemplary embodiment, the length $L_4$ is more preferably in the range between and including about 25 mm and about 35 mm. Furthermore, the connector base 310 has a width "$W_5$" that is preferably in the range between and including about 15 mm and about 35 mm. In the exemplary embodiment, the width $W_5$ is more preferably in the range between and including about 15 mm and about 25 mm.

With reference to FIG. 18, the connector base 310 includes a channel 358 defined in a top surface 360 of the connector base 310. In the exemplary embodiment, the channel 358 extends partially through the connector base 110 to a predetermined depth, as best shown in FIG. 13, that is slightly larger than a thickness of the FC 102. In addition, the channel 358 has a width "$W_6$" that is slightly larger than a width of the FC 102. As such, the channel 358 is sized and shaped to receive at least a portion of the FC 102, as illustrated in FIG. 13. The channel 358 extends from the rear wall 352 of the connector base 310 a predetermined distance along the top surface 360.

With reference to FIGS. 18 and 19, the exemplary connector base 310 includes a substantially symmetrical pair of apertures 364 with respect to line C. The apertures 364 are generally positioned centrally on the connector base 310 along the line C. The apertures 364 are substantially circular in shape and extend through the connector base 310 from a bottom surface 365 to the top surface 360. While the apertures 364 are illustrated as circular, in other embodiments, the apertures 364 may have other shapes, including, for example, and without limitation, rectangular, polygonal, and the like. The apertures 364 are sized, shaped, and positioned to be substantially complementary to the apertures 344 of the connector cap 312 and may be used to facilitate coupling the connector 308 to another structure and or additional connectors.

In addition, the connector base 310 includes a substantially symmetrical set of fastener holes 366 with respect to line C. The fastener holes 366 are generally positioned proximate the corners of the connector base 310, with one pair positioned on either side of the channel 358 proximate the rear wall 352 to facilitate providing a compression force across the FC 102 when the connector 308 is assembled for use. Each fastener hole 366 is sized and shaped to receive a respective screw 118 (shown in FIGS. 13 and 14) therethrough. As shown in FIGS. 14, 19, and 20, the fastener holes 366 include a counterbored cavity 368 defined in the bottom surface 365. Each counterbored cavity 368 is formed substantially concentric with a respective fastener hole 366. In the exemplary embodiment, the counterbored cavity 368 is sized and shaped to receive a nut 120 (shown in FIGS. 13 and 14) of the fastener assembly 116 therein. The counterbored cavity 368 may be sized to provide an interference fit to facilitate securing the nut 120 to the connector base 310. In other embodiments, the fit may be a slip fit or any other fit that enables the connector base 310 to function as described herein. Additionally or alternatively, the nut 120 may be coupled to the connector base 310 via the counterbored cavity 368 through use of a glue or adhesive. In some embodiments, the counterbored cavity 368 may have a different shape configured to receive a different type of component of the fastener assembly 116, or the counterbored cavity 368 may be omitted entirely.

Figure 21:
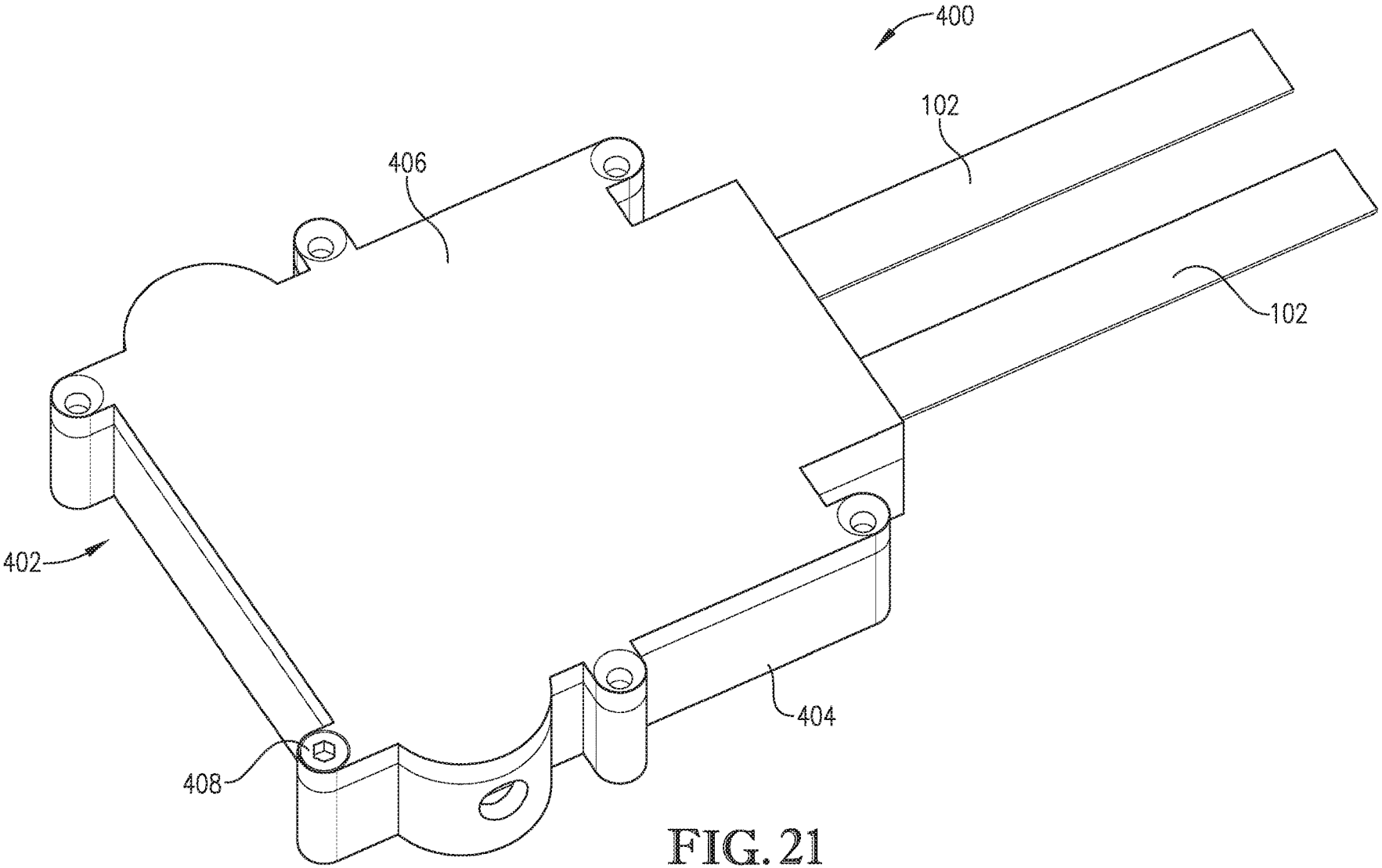
FIG. 21 is a perspective view of yet another flexible cable assembly.
Figure 22:
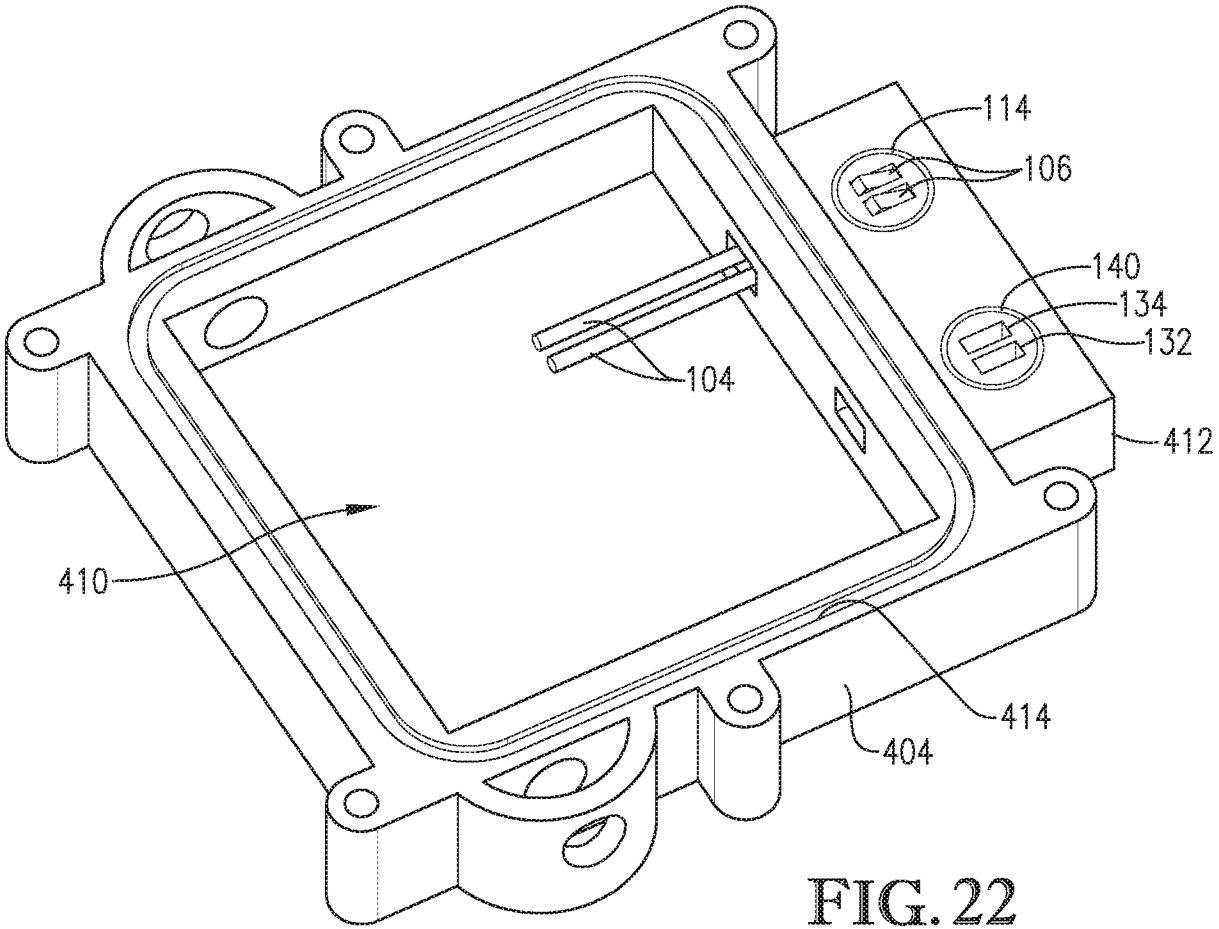
FIG. 22 is a perspective view of a connector base of the flexible cable assembly shown in FIG. 21.

FIG. 21 is a perspective view of an alternative flexible cable assembly 400 and FIG. 22 is a perspective view of a connector base 404 of the flexible cable assembly 400 of FIG. 21. In this embodiment, the cable assembly 400 includes two FCs 102 attached to a connector 402. The connector 402 includes the connector base 404 and a connector cap 406 that may be releasably coupled to the connector base 404 via one or more fasteners 408.

As illustrated in FIG. 22, the connector base 404 includes a central cavity 410 configured to receive, for example, and without limitation, an electrically conductive element therein, such as a printed circuit board (PCB), printed wire board (PWB), microchip, flexible hybrid electronics (FHE), and the like. A connection portion 412 extends from a side of the connector base 404. The connection portion 412 includes elements similar to the connector cap 112 for facilitating an electrical connection between the electrically conductive element contained in the central cavity 410 and the FCs 102. For example, the connection portion 412 may include one or more pairs of cavities, similar to terminal cavities 132 and 134, for receiving a respective spring-loaded terminal 106. The terminal cavities 132 and 134 are connected to the central cavity 410 to facilitate an electrical connection between the electrically conductive element contained therein and the FCs 102. Surrounding the terminal cavities 132 and 134 is the groove 140 configured to receive a sealing element, such as sealing element 114.

The connector base 404 includes a second groove 414 that surrounds the central cavity 410. The second groove 414 is sized and shaped to receive a second elastic member (not shown) to facilitate sealing the central cavity 410 from the outside environment. The second groove 414 extends into the connector base 404 a predetermined depth and has a cross-sectional shape that is substantially rectangular. Alternatively, the cross-sectional shape of the second groove 414 can be any shape that enables the connector 402 to function as described herein.

Advantageously, the illustrated embodiment provides easy access to change the FCs 102. For instance, where the FC 102 is a printed sensor, the connector 402 may be removed from the invasive environment, and the FC 102 may be removed by simply loosening one or more of the fasteners 408 that couple the connector cap 406 to the connector base 404 and pulling the FC 102 out. A new FC 102 can then be connected by sliding it into the space between the connector cap 406 and the connector base 404 so that the FC's electrodes are in contact with the spring-loaded terminals 106. The fastener 408 or fasteners 408 can then be retightened.

In operation, with particular reference to FIGS. 1-11, the conductive components 104 and the spring-loaded terminals 106 are inserted into the connector cap 112 through the cable access hole 130 and latched into place in the terminal cavities 132 and 134. When the spring-loaded terminals 106 are pushed through the channels 136 and 138, arms of the spring-loaded terminals 106 compress slightly. When the spring-loaded terminals 106 are pushed through the channels 136 and 138, the arms spring back to their natural position, extending at least partially through the terminal cavities 132 and 134 slightly beyond the bottom surface 133 and locking the spring-loaded terminals 106 into the terminal cavities 132 and 134. In embodiments with wires having insulating material thereon, the insulating material of the wires may extend at least partially into the cable access hole 130. In the exemplary embodiment, the cable access hole 130 is filled with a potting material that facilitates preventing the ingress of environmental influences (e.g., water, solvent, etc.). As described herein, suitable potting materials include two-part epoxy/amine resins, photocurable acrylates, silicone caulks, two-part polyurethane casting resins, polyurethanes, urethanes, and foam sealants.

The elastic member 114 is positioned between the connector cap 112 and the connector base 110 such that it surrounds the spring-loaded terminals 106 in the plane that is coplanar with the space between the connector cap 112 and the connector base 110. The groove 140 may be provided in the connector cap 112 or the connector base 110 to hold the elastic member 114 in place. The connector cap 112 and the connector base 110 are loosely coupled together via one or more fastener assemblies 116. More specifically, the locating member 142 of the connector cap 112 is inserted into the slot 162 of the connector base 110 to align the connector cap 112 with the connector base 110 and the one or more fasteners 118 are loosely threadedly coupled to a respective nut 120 contained in the connector base 110. The fastener assemblies 116 are selected to facilitate holding the connector cap 112 and the connector base 110 together tightly enough to compress the elastic member 114 and prevent environmental ingress into the region containing the spring-loaded terminals 106. The FC 102 is then clamped between the connector cap 112 and the connector base 110 in electrical contact with one or more spring-loaded terminals 106. More particularly, the FC 102 is inserted between the connector cap 112 and the connector base 110 via the alignment channel 158 defined in the connector base 110 and pushed against the locating member 142 to facilitate positioning the FC 102 in electrical contact with the spring-loaded terminals 106. The connector cap 112 and the connector base 110 are then tightly coupled together using the fastener assemblies 116 to compress the elastic member 114 and form a complete seal around the area containing the spring-loaded terminals 106. Compressing the elastic member 114, which surrounds the electrical connection between the FC 102 and the spring-loaded terminals 106, is advantageous in that the elastic member 114 provides a sealed area around the electrical connection to provide ingress protection. As such, the sealed connector 108 does not utilize a permanent sealant (e.g., epoxy, plastic, resin, and the like) to encapsulate the electrical connection, therefore enabling the FC 102 to be removed and replaced in the reusable connector 108.

Disclosed above are embodiments of reusable, environmentally sealed connector assemblies that provide ingress protection. Ingress protection includes reducing or preventing the ingress of environmental constituents into the connector, for example, that would otherwise be harmful to or interfere with the electrical connection of flexible circuits (FCs). In one preferred embodiment, the connector 108 prevents the ingress of water. When used in water, the connector 108 provides an Ingress Protection (IP) rating (as defined by IEC 60529) of at least about IP64, which is IP rated as "dust tight" and protected against water projected from a nozzle up to 60° from vertical. More preferably, the connector 108 provides an IP rating of at least about IP67, which is IP rated as "dust tight" and protected against immersion. Even more preferably, the connector 108 provides an IP rating of at least about IP68, which is IP rated as "dust tight" and protected against complete, continuous submersion in water. In other embodiments, the connector 108 can be manufactured so as to prevent the ingress of other environmental constituents, including, but not limited to, silicone oil, mineral oil, acetone, PGME, PGMEA, gasoline, diesel fuel, aqueous acids having a pH of 1 to 6, aqueous bases having a pH of 7 to 12, NMP, hexanes, ethers, esters, ketones, alcohols, and combinations thereof.

EXAMPLES

The following examples set forth methods in accordance with the above disclosure. It is to be understood, however, that these examples are provided by way of illustration and nothing therein should be taken as a limitation upon the overall scope of the invention.

Example 1—Manufacture of Upper and Lower Enclosure

The connector cap 112 and the connector base 110 were manufactured by three-dimensional (3D) printing using extrusion material GPFR03 (Formlabs, Inc.). Upon completion of the 3D printing, the connector cap 112 and the connector base 110 were cured by means of exposure to an ultraviolet light source and finished by sanding and/or buffing. Hex nuts, such as the nuts 120, were pressed into the respective four cavities 168 of the connector base 110 for use in the final mating process.

Example 2—Electrical Contact Insertion

KK 2759 Molex® terminals were attached to 22 AWG stranded wire with 300 VDC insulation, such as the conductive component 104, by first stripping the outer insulation from the 22 AWG wire and then attaching the KK 2759 terminals using Molex® crimping tool 64016-0201. The electrical wire/terminal assembly was inserted into the terminal cavity, such as terminal cavities 132 and 134, of the connector cap 112 until fully seated, as shown in FIG. 3. The remaining 22 AWG wire was routed through the cable access hole 130. This was repeated with a second wire. Potting material (Pacer Technology Corporation Anchor-Tite® waterproof epoxy [15206, 15368]) was injected into the cable access hole 130 until full.

Example 3—Final Connector Assembly

A 1 mm×7.5 mm outside diameter (OD) Buna-N O-ring was placed into the groove 140 of the connector cap 112. The connector cap 112 and the connector base 110 were coupled together and four screws, such as fasteners 118, were routed through the connector cap 112 to the hex nuts, such as nuts 120, that were previously pressed into the connector base 110. The screws were tightened until the O-ring was compressed and a seal was formed.

Example 4—Pressure Testing for Water Ingress

A pressure pot was filled to a depth of 3 inches with water. One gram of salt was added to the water and stirred. A two-electrode resistive printed sensor, such as FC 102, was inserted into the connector 108 and the connector was tightened. The sensor was inserted upside down so that no contact would be made between the two wires of the connector. Silicone was used to create an airproof seal around the wires leading out of the pressure pot from the connector 108. The connector 108 and sensor were submerged in the salt water. The resistance of the connector 108 was monitored by a Brewer Science sensor test kit. If any valid resistance was measured, it would indicate that salt water had entered the connector 108 and shorted the connection.

A pressure regulator was attached in-line to a compressed air line and a hose was used to connect the regulator to the pressure pot. All other airways on the pressure pot were sealed. The regulator was initially set to 0 psi. Over the course of 3 hours, the pressure setting of the regulator was increased by 10 psi and left to sit for approximately 20 minutes. This simulated a salt water depth of 6.86 meters. Meanwhile, the electrical signal from the connector 108 was monitored in order to detect for conduction caused by water leaks. The maximum pressure that was achievable using the equipment available was 80 psi (simulating 54.9 meters of saltwater depth). There was no evidence of water ingress throughout the entire test.

With respect to the above description, it is noted that the optimal dimensional relationships for the components of the embodiments, to include variations in size, materials, shape, form, function, and manner of operation, assembly, and use, are deemed readily apparent to one skilled in the art, and all equivalent relationships to those illustrated in the drawings and described in the specification are intended to be encompassed by an embodiment of the disclosure.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An environmentally sealed connector for connecting a spring-loaded terminal to a flexible circuit, said environmentally sealed connector comprising:

a spring-loaded terminal comprising a flexible arm;

a conductive component coupled to said spring loaded terminal;

a connector cap comprising a first mating surface, a terminal cavity having an opening defined in said first mating surface, and a cable access hole in communication with said terminal cavity, said terminal cavity receiving at least a portion of said spring-loaded terminal in order to electrically couple said spring-loaded terminal to the flexible circuit, said flexible arm extending through said opening and beyond said first mating surface to fix the spring-loaded terminal in the connector cap, said conductive component extending through said cable access hole;

a connector base releasably coupled to said connector cap, wherein said connector base covers said terminal cavity and the at least a portion of said spring-loaded terminal; and an elastic member disposed between said connector cap and said connector base, said elastic member being in sealing engagement therewith and surrounding said terminal cavity and the at least a portion of said spring-loaded terminal.

2. The environmentally sealed connector in accordance with claim 1 further comprising a potting material disposed in said cable access hole, said potting material forming a seal between said conductive component and said connector cap.

3. The environmentally sealed connector in accordance with claim 1, said connector cap comprising a groove defined in said first mating surface and surrounding said terminal cavity.

4. The environmentally sealed connector in accordance with claim 3, said elastic member disposed in said groove in sealing engagement therewith.

5. The environmentally sealed connector in accordance with claim 1, said connector cap comprising a locating member extending from said first mating surface of said connector cap;

said connector base comprising a slot defined in a second mating surface of said connector base, wherein said locating member is in physical engagement with said slot to locate said connector cap with respect to said connector base.

6. The environmentally sealed connector in accordance with claim 1, said connector cap comprising a first aperture extending therethrough;

said connector base comprising a second aperture extending therethrough, wherein said first aperture and said second aperture are coaxial.

7. The environmentally sealed connector in accordance with claim 1, said connector cap comprising a first fastener hole extending therethrough for receiving a fastener therethrough for coupling said connector cap to said connector base.

8. The environmentally sealed connector in accordance with claim 7, said first fastener hole comprising a countersunk hole.

9. The environmentally sealed connector in accordance with claim 7, said connector base comprising a second fastener hole extending therethrough, said second fastener hole being coaxial with said first fastener hole.

10. The environmentally sealed connector in accordance with claim 9, said second fastener hole comprising a counterbored cavity for receiving a fastener component therein.

11. The environmentally sealed connector in accordance with claim 1, wherein said connector cap comprising an internal sealing cavity defined therein in communication with said terminal cavity, said cable access hole in communication with said internal sealing cavity, said conductive component extending through said internal sealing cavity and said cable access hole.

12. The environmentally sealed connector in accordance with claim 11 further comprising a potting material disposed in said internal sealing cavity, said potting material forming a seal between said conductive component and said internal sealing cavity.

13. The environmentally sealed connector in accordance with claim 1, said connector base comprising a channel sized and shaped to receive at least a portion of the flexible circuit therein.

14. The environmentally sealed connector in accordance with claim 1, said elastic member comprising one or more of the following: a gasket, an O-ring, and a sealable foil.

15. The environmentally sealed connector in accordance with claim 1, wherein said connector cap and said connector base are fabricated from a rigid material comprising one of more of the following: metal, plastic, glass, ceramic, and composites.

16. The environmentally sealed connector in accordance with claim 1, wherein the flexible circuit includes an insulating polymer film having a conductive circuit formed thereon and a thin polymer coating disposed over at least a portion of the conductive circuit.

17. The environmentally sealed connector in accordance with claim 1, wherein the flexible circuit includes or more of the following: flat printed circuitry, a flat flexible circuit or cable, a sensor, a flexible printed circuit board, a flex circuit, flex print, a flexi-circuit, a rigid flexible circuit, and a flexible electronic component.

18. The environmentally sealed connector in accordance with claim 1, wherein the flexible circuit includes an electrical connection portion disposed proximate an end of the flexible circuit and in contact with said spring-loaded terminal.

19. The environmentally sealed connector in accordance with claim 1, wherein the flexible circuit includes one or more active components integrated therein.

20. The environmentally sealed connector in accordance with claim 1, wherein said elastic member in sealing engagement with said connector cap and said connector base provides an ingress protection rating of at least IP64.

21. An environmentally sealed connector for connecting a spring-loaded terminal to a flexible circuit, said environmentally sealed connector comprising:

a spring-loaded terminal comprising a conductive component coupled thereto, said spring-loaded terminal further comprising a flexible arm;

a connector base comprising:

a first mating surface;

a terminal cavity comprising an opening defined in said first mating surface, said terminal cavity receiving at least a portion of said spring-loaded terminal in order to electrically couple said spring-loaded terminal to the flexible circuit, said flexible arm extending through said opening and beyond said first mating surface to fix the spring-loaded terminal in the connector base;

a cable access hole in communication with said terminal cavity, said conductive component extending through said cable access hole; and a central cavity for receiving an electrically conductive element therein;

a connector cap releasably coupled to said connector base, wherein said connector cap covers said central cavity, said terminal cavity, and the at least a portion of said spring-loaded terminal;

a first elastic member disposed between said connector cap and said connector base, said first elastic member being in sealing engagement therewith and surrounding said terminal cavity and the at least a portion of said spring-loaded terminal; and a second elastic member disposed between said connector cap and said connector base, said second elastic member being in sealing engagement therewith and surrounding said central cavity.

22. The environmentally sealed connector in accordance with claim 21, said connector base comprising a first groove surrounding said terminal cavity and a second groove surrounding said central cavity.

23. The environmentally sealed connector in accordance with claim 22, said first elastic member disposed in said first groove in sealing engagement therewith, and said second elastic member disposed in said second groove in sealing engagement therewith.

24. The environmentally sealed connector in accordance with claim 23 further comprising:

a second spring-loaded terminal comprising a second conductive component coupled thereto; and a third elastic member disposed between said connector cap and said connector base, wherein said connector base further comprises:

a second terminal cavity for receiving at least a portion of said second spring-loaded terminal in order to electrically couple said second spring-loaded terminal to a second flexible circuit; and a third groove surrounding said second terminal cavity, wherein said third elastic member is disposed in said third groove in sealing engagement therewith and surrounding said second terminal cavity.

25. The environmentally sealed connector in accordance with claim 21, wherein the flexible circuit includes an insulating polymer film having a conductive circuit formed thereon and a thin polymer coating disposed over at least a portion of the conductive circuit.

26. The environmentally sealed connector in accordance with claim 21, wherein the flexible circuit includes or more of the following: flat printed circuitry, a flat flexible circuit or cable, a sensor, a flexible printed circuit board, a flex circuit, flex print, a flexi-circuit, a rigid flexible circuit, and a flexible electronic component.

27. The environmentally sealed connector in accordance with claim 21, wherein the flexible circuit includes an electrical connection portion disposed proximate an end of the flexible circuit and in contact with said spring-loaded terminal.

28. The environmentally sealed connector in accordance with claim 21, wherein the flexible circuit includes one or more active components integrated therein.

29. The environmentally sealed connector in accordance with claim 21, wherein said first elastic member and said second elastic member provide an ingress protection rating of at least IP64.

30. A method for releasably coupling a flexible circuit to a connector, said method comprising:

coupling a conductive component to a spring-loaded terminal;

coupling the spring-loaded terminal to a connector housing, the spring-loaded terminal having a flexible arm that extends through an opening defined in the connector housing to fix the spring-loaded terminal in the connector housing;

removably inserting the flexible circuit into the connector housing, comprising positioning the flexible circuit between a connector cap and a connector base attached to each other, the flexible circuit having an electrical connection portion positioned proximate an end of the flexible circuit, the connector cap including the spring-loaded terminal fixed therein, a cable access hole, and a terminal cavity coupled to the cable access hole, and the connector base having an alignment slot for receiving the end of the flexible circuit, the flexible circuit contacting the spring-loaded terminal of the connector to form an electrical connection within the connector housing; and sealing around the electrical connection to provide ingress protection, wherein coupling the spring-loaded terminal to the connector housing comprises inserting the spring-loaded terminal into the terminal cavity through the cable access hole such that the conductive component extends through the cable access hole.

31. The method in accordance with claim 30, wherein positioning the flexible circuit between the connector cap and the connector base comprises:

inserting the flexible circuit into the alignment slot opposite the spring-loaded terminal, the alignment slot holding the electrical connection portion in relation to the spring-loaded terminal.

32. The method in accordance with claim 30, wherein the flexible circuit includes an insulating polymer film having a conductive circuit formed thereon and a thin polymer coating disposed over at least a portion of the conductive circuit.

33. The method in accordance with claim 30, wherein the flexible circuit includes or more of the following: flat printed circuitry, a flat flexible circuit or cable, a sensor, a flexible printed circuit board, a flex circuit, flex print, a flexi-circuit, a rigid flexible circuit, and a flexible electronic component.

34. The method in accordance with claim 30, wherein the flexible circuit includes one or more active components integrated therein.

35. The method in accordance with claim 30, wherein sealing around the electrical connection comprises:

positioning an elastic member between the connector cap and the connector base such that the elastic member surrounds the spring-loaded terminal in a plane that is coplanar with the space between the connector cap and the connector base.

36. The method in accordance with claim 35, wherein positioning the elastic member between the connector cap and the connector base comprises:

inserting the elastic member into a groove defined in one or more of the connector cap and the connector base.

37. The method in accordance with claim 35, wherein sealing around the electrical connection comprises:

coupling the connector cap and the connector base together to compress the elastic member.

38. The method in accordance with claim 30 further comprising:

filling the cable access hole with a potting material.

39. The method in accordance with claim 30, wherein sealing around the electrical connection to provide ingress protection comprises sealing around the electrical connection to provide an ingress protection rating of at least IP64.

* * * * *